US012523401B2

(12) United States Patent
King

(10) Patent No.: US 12,523,401 B2
(45) Date of Patent: Jan. 13, 2026

(54) REFRIGERANT RECOVERY SYSTEM AND RECOVERY CART THEREOF

(71) Applicant: TRANE INTERNATIONAL INC., Davidson, NC (US)

(72) Inventor: Matt King, La Crosse, WI (US)

(73) Assignee: TRANE INTERNATIONAL INC., Davidson, NC (US)

( * ) Notice: Subject to any disclaimer, the term of this patent is extended or adjusted under 35 U.S.C. 154(b) by 313 days.

(21) Appl. No.: 18/332,501

(22) Filed: Jun. 9, 2023

(65) Prior Publication Data

US 2024/0410631 A1 Dec. 12, 2024

(51) Int. Cl.
*F25B 45/00* (2006.01)
*F25B 41/20* (2021.01)

(52) U.S. Cl.
CPC ..... *F25B 45/00* (2013.01); *F25B 41/20* (2021.01); *F25B 2345/002* (2013.01)

(58) Field of Classification Search
CPC ..... F25B 45/00; F25B 2345/001; F25B 2345/002; F25B 2345/003; F25B 2345/004; F25B 2345/005; F25B 2345/0052; F25B 2345/006; F25B 41/20; F25B 41/42; F25B 41/40
See application file for complete search history.

(56) References Cited

U.S. PATENT DOCUMENTS 8,572,992 B2 11/2013 Murray et al.
8,590,321 B2 11/2013 McMasters

FOREIGN PATENT DOCUMENTS

| | | | |
|---|---|---|---|
| EP | 2199710 B1 | | 9/2011 |
| JP | H08-082465 A | | 3/1996 |
| JP | 2000-292039 A | | 10/2000 |
| JP | 2017072284 A | * | 4/2017 |
| KR | 20-0371465 Y1 | | 12/2004 |
| KR | 10-1467902 B1 | | 12/2014 |

OTHER PUBLICATIONS

English translation of Akimoto (JP 2017072284 A). (Year: 2017).*
International Search Report and Written Opinion, International Patent Application No. PCT/US2024/033117, Sep. 20, 2024 (11 pages).

* cited by examiner

*Primary Examiner* — Miguel A Diaz
(74) *Attorney, Agent, or Firm* — HSML P.C.

(57) ABSTRACT

A refrigerant recovery system includes a refrigerant circuit with a vacuum pump, a first connection port, a second connection port, an exhaust port, and multiple-way valves that selectively fluidly connect said ports to the vacuum pump. The multiple-way valves have a first configuration, a second configuration, and a third configuration for fluidly connecting the ports to a suction inlet and a discharge outlet of the vacuum pump. A method is for recovering refrigerant from a refrigerant circuit using a refrigerant recovery system. The method includes operating the refrigerant recovery system in a liquid recovery configuration to transfer liquid refrigerant in an refrigerant circuit into one or more recovery cylinders and operating the refrigerant recovery system in a gas recovery configuration to transfer gaseous refrigerant in the refrigerant circuit into the one or more recovery cylinders. A recovery cart includes a transfer circuit of a refrigerant recovery system.

20 Claims, 13 Drawing Sheets

REFRIGERANT RECOVERY SYSTEM AND RECOVERY CART THEREOF

FIELD

This disclosure relates to recovery of refrigerant from refrigerant circuits for a heating, ventilation, air conditioning, and refrigeration ("HVACR") systems. More particularly, this disclosure relates refrigerant recovery carts and refrigerant recovery systems used in recovering the refrigerant from refrigerant circuits of HVACR systems.

BACKGROUND

Heating, ventilation, air conditioning, and refrigeration ("HVACR") systems are generally used to heat, cool, and/or ventilate an enclosed space (e.g., an interior space of a commercial building or a residential building, an interior space of a refrigerated transport unit, or the like). A HVACR system may include a refrigerant circuit for providing cooled or heated air to the area. The refrigerant circuit utilizes a working fluid containing refrigerant to cool or heat the air directly or indirectly. The working fluid/refrigerant can be removed from the refrigerant to allow for some servicing of the refrigerant circuit (e.g., replacement of components of the refrigerant circuit, or the like). A recovery cart may be used to transfer the working fluid/refrigerant from the refrigerant circuit into one or more recovery cylinders.

SUMMARY

In an embodiment, a refrigerant recovery system includes a transfer circuit. The transfer circuit includes a vacuum pump, a plurality of ports, and a plurality of multiple-way valves. The vacuum pump includes a suction inlet and a discharge outlet. The plurality of ports including a first connection port, a second connection port, and an exhaust port. The plurality of multiple-way valves selectively fluidly connecting the first connection port, the second connection port, and the exhaust port to the vacuum pump. The plurality of ports has a first configuration, a second configuration, and a third configuration. The first configuration fluidly connects the first connection port to the suction inlet of the vacuum pump and fluidly connects the second connection port to the discharge outlet of the vacuum pump. The second configuration fluidly connects the first connection port to the discharge outlet of the vacuum pump and fluidly connects the second connection port to the suction inlet of the vacuum pump. The third configuration fluidly connects the suction inlet of the vacuum pump to each of the first connection port and the second connection port and fluidly connects the discharge outlet to the exhaust port.

In an embodiment, the refrigerant recovery system includes a refrigerant recovery cart. The refrigerant recovery cart including the transfer circuit.

In an embodiment, the refrigerant recovery system includes a heating tank configured to evaporate liquid refrigerant prior to flowing into the transfer circuit.

In an embodiment, the second configuration is a liquid recovery configuration for recovering liquid refrigerant from the refrigerant circuit.

In an embodiment, the transfer circuit includes a bypass valve that is configured to selectively connect the first connection port and the second connection port.

In an embodiment, the transfer circuit includes a condenser. In the second configuration of the valves, the discharge outlet of the vacuum pump is fluidly connected to the first connection port via the condenser, the second configuration being a gaseous refrigerant recovery configuration.

In an embodiment in the first configuration of the valves, the vacuum pump is configured to suction gaseous refrigerant into the transfer circuit through the second connection port and to discharge liquid refrigerant from the transfer circuit through the first connection port. The gaseous refrigerant flowing from the vacuum pump to the first connection port is condensed, by the condenser, into the liquid refrigerant.

In an embodiment, in the third configuration of the valves, the vacuum pump is configured to discharge remaining refrigerant in the transfer circuit through the exhaust port.

In an embodiment, the plurality of multiple-way valves includes three or more of the multiple-way valves.

In an embodiment, the plurality of multiple-way valves includes two or more three-way valves.

In an embodiment, a method is directed to recovering refrigerant from a refrigerant circuit using a refrigerant recovery system. The refrigerant recovery system includes a transfer circuit with a vacuum pump, a first connection port, a second connection port, an exhaust port, and a plurality of multiple-way valves. The method includes operating the refrigerant recovery system in a liquid recovery configuration to transfer liquid refrigerant in the refrigerant circuit into one or more recovery cylinders. Operating in the liquid recovery configuration includes adjusting the plurality of multiple-way valves such that a discharge outlet of the vacuum pump is fluidly connected to a refrigerant circuit in the refrigerant circuit via the second connection port and a suction inlet of the vacuum pump is fluidly connected to the one or more recovery cylinders via the first connection port. Operating in the liquid recovery configuration also includes the vacuum pump suctioning from the one or more recovery cylinders and discharging into the refrigerant circuit. The method also includes operating the refrigerant recovery system in a gas recovery configuration to transfer gaseous refrigerant in the refrigerant circuit into the one or more recovery cylinders. Operating in the gas recovery configuration includes adjusting the plurality of multiple-way valves such that the discharge outlet of the vacuum pump is fluidly connected to the one or more recovery cylinders via the first connection port and the suction inlet of the vacuum pump is fluidly connected to the refrigerant circuit via the second connection port. The operating in the gas recovery configuration also includes the vacuum pump suctioning from the refrigerant circuit and discharging into the one or more recovery cylinders.

In an embodiment, the operating of the refrigerant recovery system in the liquid recovery configuration includes fluidly connecting the one or more recovery cylinders to the refrigerant circuit with a hose. The vacuum pump suctioning from the one or more recovery cylinders and discharging into the refrigerant circuit causes the liquid refrigerant to flow through the hose from the refrigerant circuit to the one or more recovery cylinders.

In an embodiment, the transfer circuit includes a condenser. In the gas recovery configuration, the discharge outlet of the vacuum pump is fluidly connected to the first connection port via the condenser. The transferring of the gaseous refrigerant in the refrigerant circuit from the refrigerant circuit into the one or more recovery cylinders includes condensing, with the condenser, the gaseous refrigerant into liquid refrigerant as the gaseous refrigerant flows through the transfer circuit.

In an embodiment, the refrigerant recovery system includes a heating tank. In the gas recovery configuration, the second connection port is fluidly connected to the refrigerant circuit via the heating tank. The operating of the refrigerant recovery system in the gas recovery configuration includes evaporating, with the heating tank, liquid refrigerant mixed with the gaseous refrigerant suctioned from the refrigerant circuit.

In an embodiment, the method also includes operating the refrigerant recovery system in a gas charging configuration to transfer the gaseous refrigerant in the one or more recovery cylinders into the refrigerant circuit. The method also includes operating the refrigerant recovery system in a liquid charging configuration to transfer the liquid refrigerant in the one or more recovery cylinders into the refrigerant circuit.

In an embodiment, the refrigerant recovery system includes a refrigerant recovery cart with the transfer circuit.

In an embodiment, the transfer circuit includes a bypass valve configured to selectively connect the first connection port and the second connection port, the bypass valve being closed in the liquid recovery configuration and in the gas recovery configuration.

In an embodiment, the transfer circuit includes a bypass valve. The method also includes operating the refrigerant recovery system in a gas self-evacuation configuration. Operating in the gas self-evacuation configuration includes adjusting the plurality of multiple-way valves and the bypass valve such that the suction inlet of the vacuum pump is fluidly connected to both the first connection port and the second connection port and the discharge outlet of the vacuum pump is fluidly connected to the exhaust port, within the transfer circuit. Operating in the gas self-evacuation configuration also includes discharging the gaseous refrigerant remaining in the transfer circuit into the one or more recovery cylinders via the exhaust port.

In an embodiment, the plurality of multiple-way valves includes three or more of the multiple-way valves.

In an embodiment, the plurality of multiple-way valves includes two or more three-way valves.

DRAWINGS

Like numbers represent like features.

DETAILED DESCRIPTION

An HVACR system can be used to cool or heat one or more conditioned spaces. A HVACR system may utilize a refrigerant in a circuit to cool or heat a process fluid (e.g., air, water, chiller liquid, or the like). For example, an HVACR system in some instances will cool and/or heat an area by performing work on a refrigerant that is in a heat exchange relationship with air. The cooled or heated air may then be ventilated to an area to cool or heat the area. For example, an HVACR systems in some instances will cool an area by preforming work on a refrigerant that is in a heat exchanger relationship with a chiller liquid (e.g., water, glycol and/or water mixture, or the like).

Figure 1:
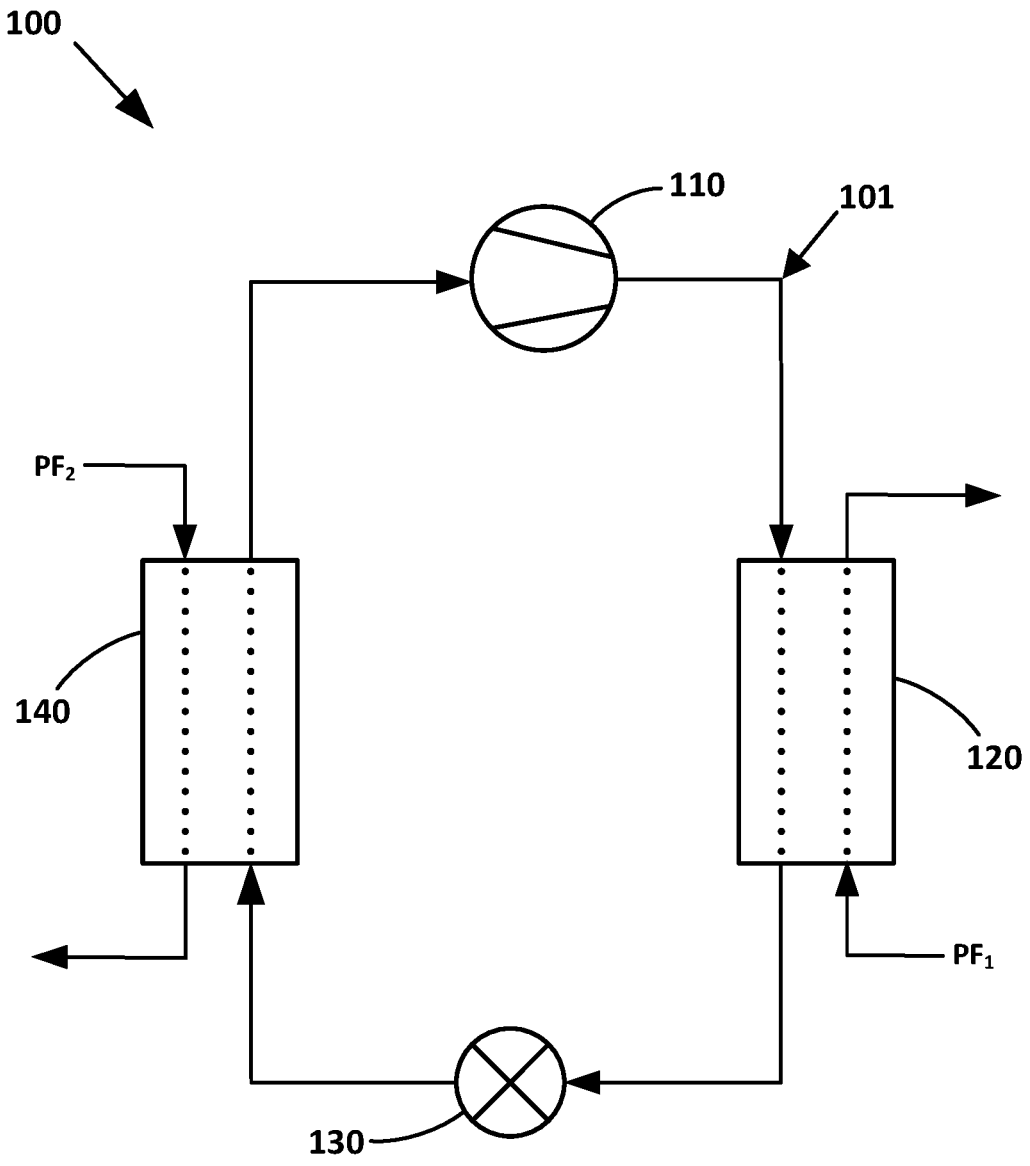
FIG. 1 is a schematic diagram of an embodiment of a refrigerant circuit in a heating, ventilation, air conditioning, and refrigeration (HVACR) system.

FIG. 1 is a schematic diagram of an embodiment of a refrigerant circuit 101 in a heating, ventilation, air conditioning, and refrigeration (HVACR) system 100. In an embodiment, the HVACR system 100 may be an industrial or residential HVACR system 100 configured to condition the inside of a building (e.g., office space, residential house, or the like). In an embodiment, the HVACR system 100 may be a transport HVACR used for cooling the inside of a transport unit (e.g., shipping container, transport/trucking container, reefer, or the like) and/or a passenger vehicle (e.g., a bus, a plane, or the like).

The refrigerant circuit 101 includes a compressor 110, a condenser 120, an expansion device 30, and an evaporator 140. In an embodiment, the refrigerant circuit 101 can be modified to include additional components. For example, the refrigerant circuit 101 in an embodiment can include an economizer heat exchanger, one or more flow control devices, a receiver tank, a dryer, a suction-liquid heat exchanger, or the like. he components of the refrigerant circuit 101 are fluidly connected. Dotted lines and dotted dashed lines are provided in the Figures to indicate fluid flows through some components (e.g., condenser 120, evaporator 140) for clarity, and should be understood as not specifying a specific route within each component.

The refrigerant circuit 101 applies known principles of gas compression and heat transfer. The refrigerant circuit can be configured to heat or cool a process fluid (e.g., water, air, chiller fluid, or the like). In an embodiment, the refrigerant circuit 101 may represent a chiller that cools a process fluid such as water or the like. In an embodiment, the refrigerant circuit 101 may represent an air conditioner and/or a heat pump that cools and/or heats a process fluid such as air, water, or the like.

During the operation of the refrigerant circuit 101, a working fluid (e.g., containing refrigerant, refrigerant mixture, or the like) flows into the compressor 110 from the evaporator 140 in a gaseous state at a relatively lower pressure. The compressor 110 compresses the gas into a high pressure state, which also heats the gas. After being compressed, the relatively higher pressure and higher temperature gas flows from the compressor 110 to the condenser 120. In addition to the working fluid flowing through the condenser 120, a first process fluid $PF_1$ (e.g., external air, external water, cooling/heater water, or the like) also separately flows through the condenser 120. The first process fluid absorbs heat from the working fluid as the first process fluid $PF_1$ flows through the condenser 120, which cools the working fluid as it flows through the condenser. The working fluid condenses to liquid and then flows into the expansion device 30. The expansion device 30 allows the working fluid to expand, which converts the working fluid to a mixed vapor and liquid state. An "expansion device" as described herein may also be referred to as an expander. In an embodiment, the expander may be an expansion valve, expansion plate, expansion vessel, orifice, or the like, or other such types of expansion mechanisms. It should be appreciated that the expander may be any type of expander used in the field for expanding a working fluid to cause the gaseous working fluid to decrease in pressure and temperature.

The relatively lower temperature, vapor/liquid working fluid then flows into the evaporator 140. A second process fluid $PF_2$ (e.g., air, chiller liquid, water, or the like) also flows through the evaporator 140. The working fluid absorbs heat from the second process fluid $PF_2$ as it flows through the evaporator 140, which cools the second process fluid $PF_2$ as it flows through the evaporator 140. As the working fluid absorbs heat, the working fluid evaporates to vapor. The working fluid then returns to the compressor 110 from the evaporator 140. The above-described process continues while the refrigerant circuit 101 is operated, for example, in a cooling mode.

The refrigerant circuit 101 can be configured as a cooling system (e.g., a chiller of an HVACR, an air conditioning system, or the like) that can be operated in a cooling mode, and/or the refrigerant circuit 101 can be configured to operate as a heat pump system that can run in a cooling mode and a heating mode. In an embodiment, the refrigerant circuit 101 is a chiller that cools the second process fluid $PF_2$ that is a chiller liquid (e.g., water, glycol and/or water mixture, or the like).

Figure 2:
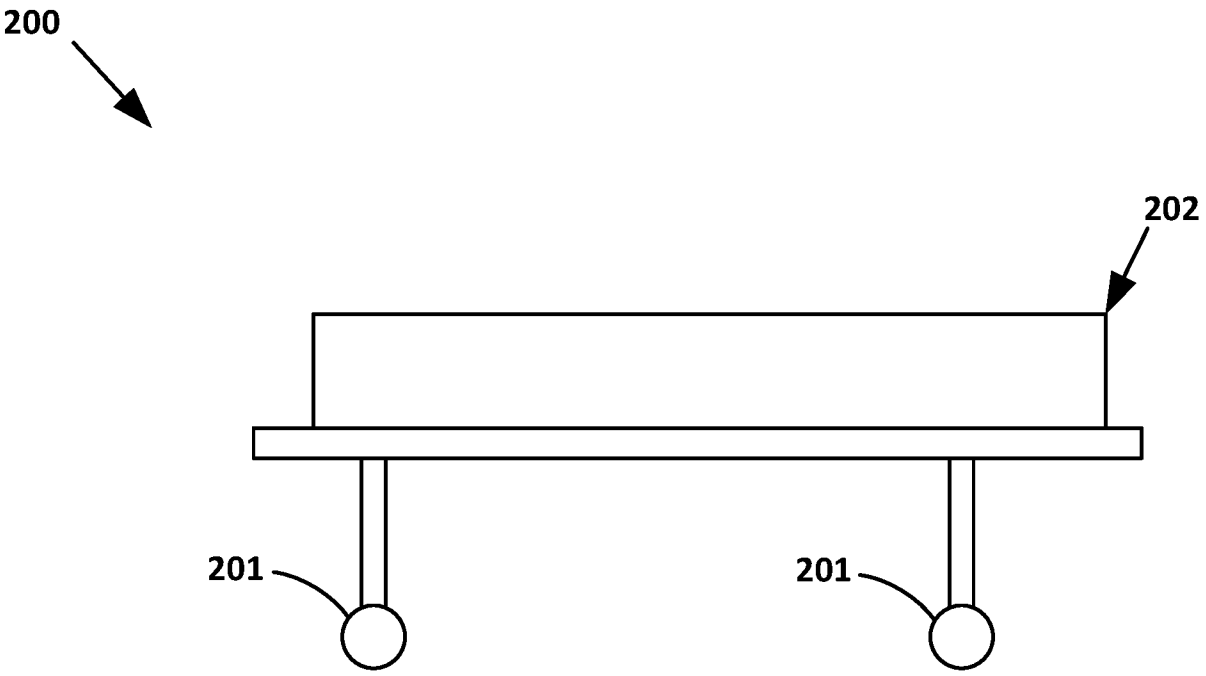
FIG. 2 is a side schematic view of an embodiment of a recovery cart of a refrigerant recovery system.

FIG. 2 shows a side schematic view of an embodiment of a recovery cart 202 of a refrigerant recovery system 200. The recovery cart 202 is used for removing a refrigerant (that includes refrigerant) from an HVACR system. The recovery cart 202 is a mobile cart configured to be moved/transported to different HVACR systems. For example, the recovery cart 202 can include wheels 201 for rolling the recovery cart 202 (e.g., along the ground) from one HVACR system to the next HVACR system. In the illustrated embodiment, the refrigerant recovery system 200 is configured to recover refrigerant from a refrigerant circuit 202 on-site (e.g., without removing the refrigerant circuit/system from its operating location). In another embodiment, the refrigerant recovery system 200 may be configured to be stationary, such as being part of a workbench, a workstation, a testing laboratory, or the like.

Figure 3:
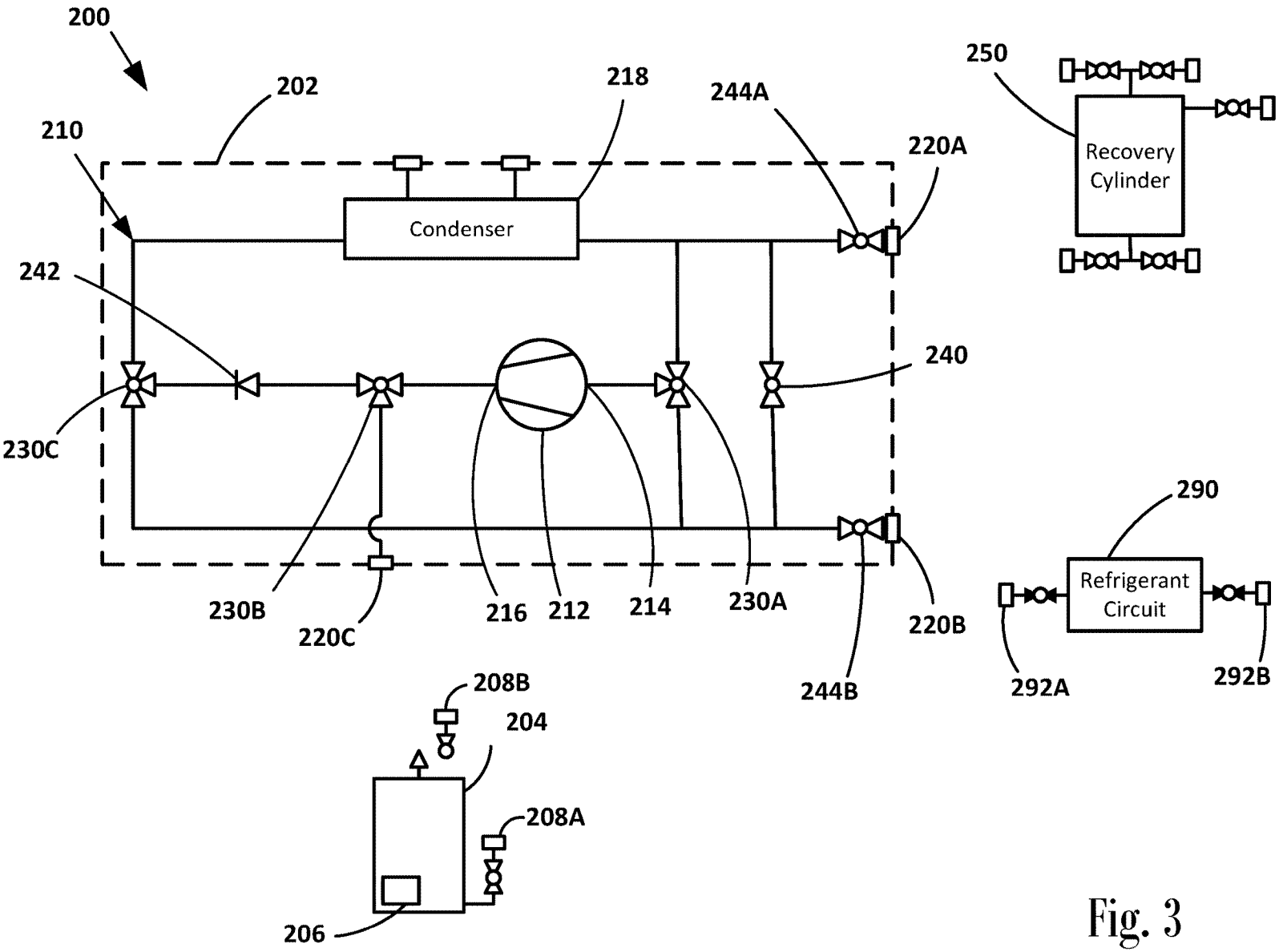
FIG. 3 is a schematic diagram of an embodiment of the refrigerant recovery system in FIG. 2 and a refrigerant circuit.

FIG. 3 is a schematic diagram of an embodiment of a refrigerant recovery system 200 and a refrigerant circuit 290. The refrigerant recovery system 200 includes the recovery cart 202 and a heating tank 204. The recovery cart 202 includes a transfer circuit 210. The refrigerant recovery system 200 is configured to transfer refrigerant in a refrigerant circuit 290 (shown in FIGS. 4-11) into one or more recovery cylinder(s) 250. The term "refrigerant" as used with respect to the refrigerant recovery system 200 (and the method 1000 in FIG. 13) refers to the entire refrigerant used as discussed above with respect to the refrigerant circuit 105 in FIG. 1, unless stated otherwise. For example, the "refrigerant" in the refrigerant circuit 290 refers to both the refrigerant compound(s) themselves (e.g., R11, R113, R123a, R1234yf, R123zde, R514A, and the like) and any refrigerant additives mixed with the refrigerant(s) (e.g., antioxidants, stabilizers, anti-foaming agent(s), flammability reducers, and the like). The refrigerant recovery system 200 can also be used for transferring the recovered refrigerant in the recovery cylinder(s) 250 back into the refrigerant circuit 290. For example, the refrigerant circuit 290 in an embodiment may be the refrigerant circuit 101 of FIG. 1. The employment of the refrigerant recovery system 200 is discussed in more detail below.

As shown in FIG. 3, the transfer circuit 210 includes a vacuum pump 212, a condenser 218, refrigerant ports, a plurality of multiple-way valves, and a bypass valve 240 that are fluidly connected. The vacuum pump 212 includes a suction inlet 214 and a discharge outlet 216. Gaseous refrigerant is suctioned into suction inlet 214 of the vacuum pump 212, is compressed within the vacuum pump 212, and is discharged as compressed refrigerant from the discharge outlet 216 of the vacuum pump 212. The refrigerant is discharged from the discharge outlet 216 at a higher pressure then the refrigerant flowing into the suction inlet 214.

The vacuum pump 212 is an oil-free vacuum pump. In an embodiment, the vacuum pump 212 may be, but is not limited to, an oil-free scroll compressor. The transfer circuit 210 and the recovery cart 202 do not contain an oil separator. In an embodiment, the cart 202 advantageously weighs substantially less than a conventional recovery carts recovery cart that utilizes oil (e.g., lubricant, mineral oil, or the like). The reduced weight can help with transporting the cart 202 and/or in preventing injuries to the user while moving the cart 202. In an embodiment, the recovery cart 202 weighs less than 200 pounds. In one embodiment, the recovery cart 202 weighed from at or about 115 pounds to at or about 175 pounds. For example, the recovery cart 202 in an embodiment can weigh at least 60 pounds less than the conventional oil-containing recovery cart. In one example, the recovery card 202 weighed at or about 100 pounds lighter than the conventional oil-containing/lubricated recovery cart.

The refrigerant ports include a first connection port 220A, a second connection port 220B, and an exhaust port 220C. In the illustrated embodiment, the first connection port 220A is an inlet-outlet port configured to be connected to the recovery cylinder(s) 250 (shown in FIG. 4). In the illustrated embodiment, the second connection port 220B is an inlet-outlet port configured to be connected to the refrigerant circuit 290 (shown in FIG. 4). An "inlet-outlet port" refers to a port that is an inlet of the transfer circuit 210 in one valve configuration of the transfer circuit 210 and is an outlet of the transfer circuit 210 in a different valve configuration of the transfer circuit 210.

The multiple-way valves include a first multiple-way valve 230A, a second multiple-way valve 230B, and a third multiple-way valve 230C. For example, the multiple-way valves 230A, 230B, 230C can be three-way valves as shown in FIG. 3. The multiple-way valve 230A, 230B, 230C selectively fluidly connect the first connection port 220A, the second connection port 220B, and the exhaust port 220C to the vacuum pump 212.

The first multiple-way valve 230A selectively connects the suction inlet 214 of the vacuum pump 212 to the first connection port 220A and the second connection port 220B. The second multiple-way valve 230B selectively connects the discharge outlet 216 of the vacuum pump 212 to the exhaust port 220C and the third multiple-way valve 230C. As shown in FIG. 3, the transfer circuit 210 can also include a check valve 242 disposed between the second multiple-way valve 230B and the third multiple-way valve 230C (e.g., the second multiple-way valve 230B fluidly connected to the third multiple-way valve 230C via the check valve 242). The third multiple-way valve 230C selectively connects the second multiple-way valve 230B to the first connection port 220A (e.g., via the condenser 218) and the second connection port 220B.

The bypass valve 240 selectively fluidly connects the first connection port 220A and the second connection port 220B. When open, the bypass valve 240 fluidly connects the first connection port 220A to the second connection port 220B. The bypass valve 240 allows refrigerant to bypass the multiple-way valves 230A, 230B, 230C within the transfer circuit 210. In particular, the bypass valve 204 is a bypass for the first multiple-way valve 230A. For example, the bypass valve 240 when open is configured to allow refrigerant to flow through the transfer circuit 210 (e.g., from the first connection port 220A to the second connection port 220B) without passing through any of the multiple-way valves 230A, 230B, 230C and the vacuum pump 212.

The transfer circuit 210 can also include a respective shutoff valve 244A, 244B for each of the first connection port 220A and the second connection port 220B. For example, the first connection port 220A may be a port of a first shutoff valve 244A, and the second connection port 220B may be a port of a second shutoff valve 244B. For example, the exhaust port 220A can be a port of the third three-way valve 230B.

In an embodiment, the valves in the transfer circuit 210 may be configured to be operated by hand (e.g., turned by a user, or the like). In another embodiment, the valves in the transfer circuit 210 may be controlled by a controller (not shown) of the transfer circuit 210. For example, the valves may be electronic and/or pneumatic valves that are operated by the controller of the transfer circuit 210. A user may use the controller to change the valves between different configurations as described below.

The heating tank 204 includes a heater 206, an inlet port 208A, and an outlet port 208B. The heating tank 204 is configured to operate as a vapor-liquid separator and an evaporator. The heater 206 is configured to heat liquid refrigerant within the heating tank 206 such that the liquid refrigerant is evaporated. The outlet port 208B of the heating tank 204 is a gaseous outlet port configured to discharge the gaseous refrigerant within the heating tank 204. For example, mixed phase refrigerant flows into the heating tank 204 through the inlet port 208A, the gaseous refrigerant in the mixed phase passes through the heating tank 204 while liquid refrigerant in the mixed phase remains within the heating tank 204. The accumulated liquid refrigerant is heated and evaporated within the heating tank 204, and the resulting gaseous refrigerant flows from the heating tank 204. The refrigerant discharged from the heating tank 204 is in gaseous form. The heating tank 204 is used to prevent liquid refrigerant from flowing into the transfer circuit 210 and into the vacuum pump 212.

As shown in FIG. 3, the heating tank 206 is a separate component from the cart 202 and the transfer circuit 210. For example, the heating tank 206 can be carried separately from the cart 202. In another embodiment, the heating tank 206 may be mounted to the cart 202.

In an embodiment, the heater 206 of the heating tank 204 is an electric heater. For example, the heater 206 may be an electric band heater wrapped around the tank of the heating tank 204. In another embodiment, the heater 206 may be an electric heater incorporated into a wall, bottom, or the like of the tank or disposed within the tank. In another embodiment, the heater 204 may be configured to utilize a fluid to heat and evaporate the liquid refrigerant within the heating tank 204. For example, the heater 204 may be a heat exchanger incorporated into the heating tank 204. Examples of the fluids that might be utilized by the heater 206 may be, but are not limited to, hot water, boiler water, a high temperature fluid/refrigerant from a heat pump, or the like. For example, the fluid utilized by the heater 204 is supplied at a sufficiently high temperature to evaporate the liquid refrigerant within the heating tank 204. The fluid utilized by the heater 204 can be different from the process fluid utilized by the condenser in the refrigerant circuit (e.g., different from the first process fluid $PF_1$ in FIG. 1).

The refrigerant circuit 290 includes a first port 292A and a second port 292B for transferring refrigerant. The first port 292A is a vapor port configured for transferring gaseous refrigerant (e.g., from the refrigerant circuit 210, into the refrigerant circuit 210). For example, the first port 292A is located within the refrigerant circuit so as to suction gaseous refrigerant instead of liquid refrigerant (e.g., located above a liquid level in an evaporator or condenser of the refrigerant circuit 210). The second port 292A is a liquid port configured for transferring liquid refrigerant (e.g., from the refrigerant circuit 210, into the refrigerant circuit 210). For example, the second port 292B is located a relatively lower location within the refrigerant circuit so as to drain/suction liquid refrigerant (e.g., located at or near a bottom of an evaporator or condenser of the refrigerant circuit 210, or the like). In an embodiment, the first port 292A and the second port 292B can be disposed in one or more of the evaporator and the condenser of the refrigerant circuit 210 (e.g., in condenser 120, in evaporator 140 in the refrigerant circuit 101 in FIG. 1).

The recovery cylinder(s) 250 are vessel(s) used for storing the recovered refrigerant. The recovery cylinder(s) 250 are vessel(s) configured for storing refrigerant. A recovery cylinder 250 is not limited to a particular size and/or shape (e.g., can be a shape other than cylindrical). In the illustrated embodiment, a single recovery cylinder 250 is shown. It should be appreciated that the number of recovery cylinders 250 depends on an amount of refrigerant to be recovered/removed and a size/volume of each cylinder. In an embodiment, the one or more cylinder(s) 250 may be a plurality of recovery cylinders 250 (e.g., two or more recovery cylinders 250).

Figure 4:
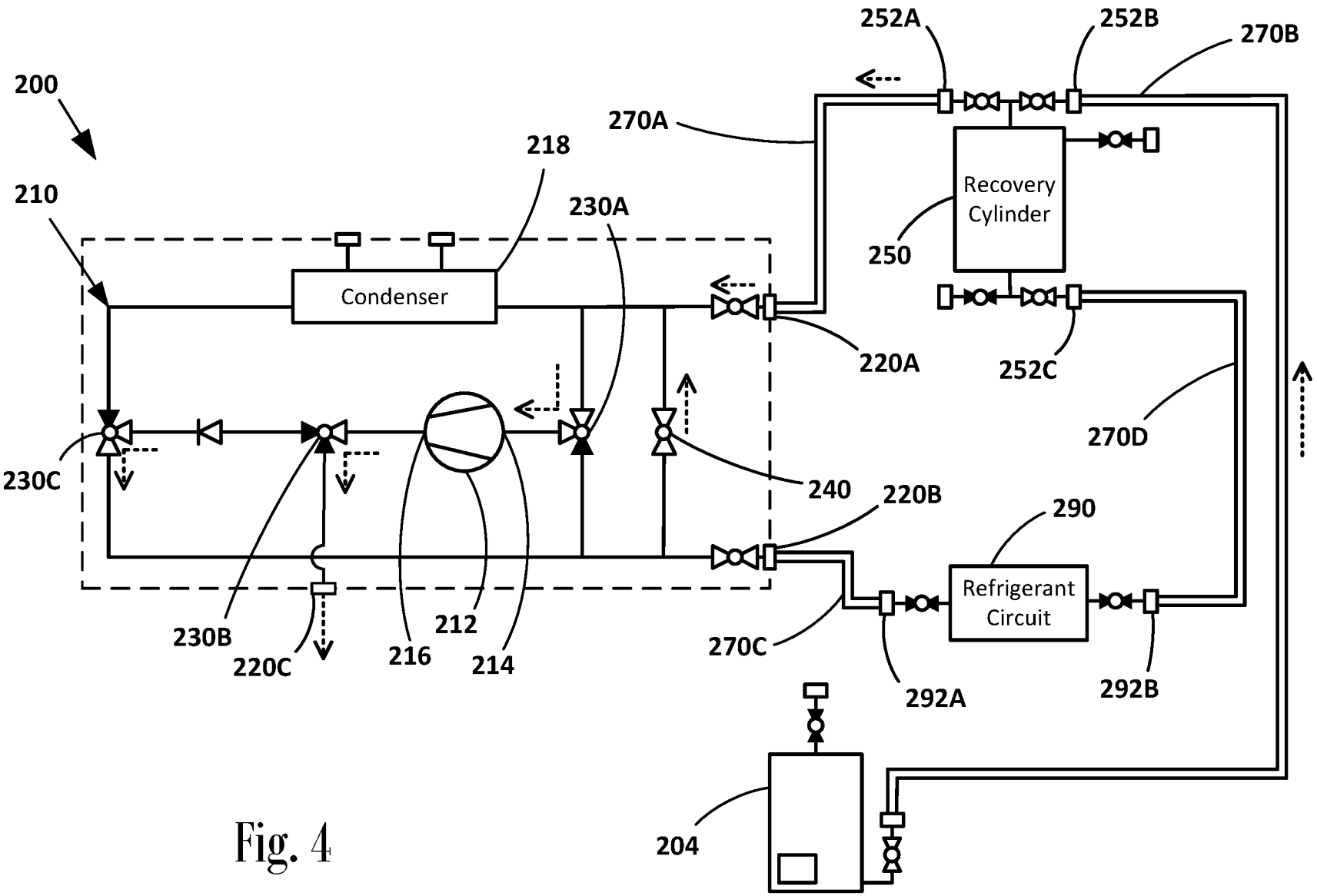
FIG. 4 is a schematic diagram of the refrigerant circuit and the refrigerant recovery system of FIG. 3, with the refrigerant recovery system in a recovery preparation configuration, according to an embodiment.
Figure 8:
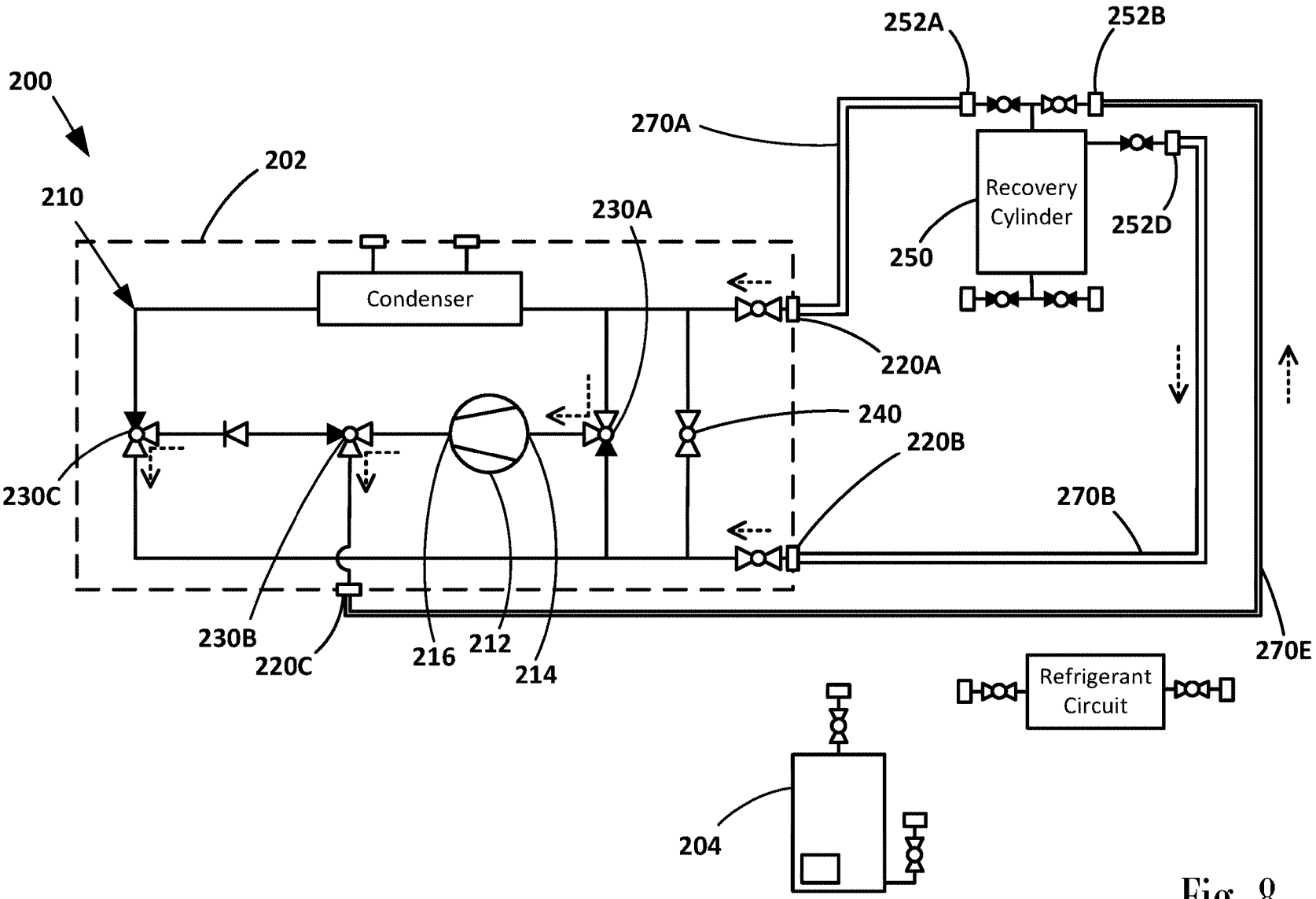
FIG. 8 is a schematic diagram of the refrigerant circuit and the refrigerant recovery system of FIG. 3, with the refrigerant recovery system in a gas self-evacuation configuration, according to an embodiment.

The refrigerant recovery system 200 can include a plurality of hoses 270A, 270B, 270C, 270D, 270E (e.g., shown in FIGS. 4 and 8). The hoses 270A, 270B, 270C, 270D, 270E are used for fluidly connecting the transfer circuit 210 to each of the refrigerant circuit 210 and the one or more recovery cylinder(s) 250 and for fluidly connecting the one or more recovery cylinder(s) 250 to the refrigerant circuit 210. For example, each hose has a first end that couples to a port in one of the transfer circuit 210, the recovery cylinder(s) 250, and the refrigerant circuit 290 and a second end that couples to a port in a different one of the transfer circuit 210, the recovery cylinder(s) 250, and the refrigerant circuit 290. In an embodiment, each hose may include a respective shutoff valve (not shown) at one or both of its ends configured to be closed when the end is uncoupled (e.g., to prevent refrigerant from leaking out of the disconnected end, to prevent air from leaking into the disconnected end). For example, the shutoff valves may form the ends of the hoses that are coupled to the ports of the transfer circuit 210, the recovery cylinder(s) 250, and the refrigerant circuit 290.

FIGS. 4-12 show an embodiment of the refrigerant recovery system 200 being used to recover the refrigerant in the refrigerant circuit 290 and then transfer the recovered refrigerant back into the refrigerant circuit 290. FIGS. 4-12 show different configurations for the refrigerant recovery system 200 in removing and then returning the refrigerant in the refrigerant circuit 290. For example, FIGS. 4-8 correspond to the transfer of the refrigerant from the refrigerant circuit 290 into recovery cylinder(s) 250, and FIGS. 9-12 correspond to the transfer of the recovered refrigerant from the recovery cylinder(s) 250 back into the refrigerant circuit 290. In FIGS. 4-12, a solid interior indicates a closed port and a white interior indicates an open port in the valves. In the illustrated embodiment, the recovered refrigerant is placed back into the refrigerant circuit 290 (e.g., after the refrigerant circuit 290 has been serviced, or the like). In another embodiment, the refrigerant recovery system 200 may be used for one or more of recovering refrigerant, adding refrigerant, and/or retrofitting a refrigerant in a refrigerant circuit. For example, the refrigerant recovery system 200 may be used for recovering refrigerant from the refrigerant circuit 290 and to add a new/replacement refrigerant to the refrigerant circuit 290.

FIG. 4 shows the refrigerant recovery system 200 in a recovery preparation configuration. In the recovery preparation configuration, the refrigerant recovery system 200 is configured to evacuate the recovery cylinder(s) 250 and the heating tank 204.

The first connection port 220A of the transfer circuit 210 is fluidly connected to the one or more the recovery cylinder(s) 250 and the heating tank 204. As shown in FIG. 4, the first connection port 220A is fluidly connected to the heating tank 204 via the recovery cylinder(s) 250. For example, a (first) hose 270A fluidly connects the first connection port 220A of the transfer circuit 210 to the recovery cylinder(s) 250 (e.g., to a first port 252A of a first recovery cylinder 250). For example, a (second) hose 270B fluidly connects the recovery cylinder(s) 250 to the heating tank 204 (e.g., fluidly connects a second port 252B of the recovery cylinder(s) 250 to the heating tank 204).

The second connection port 220B of the transfer circuit 210 can be fluidly connected to the first port 292A of the refrigerant circuit 290. For example, a (third) hose 270C fluidly connects the second connection port 220B to the first port 292A of the refrigerant circuit 290. The second connection port 220B and/or the first port 292A of the refrigerant circuit 290 is closed (e.g., the shutoff valve of the second connection port 220B is closed, the shutoff valve of the first port 292A is closed) such that refrigerant does not flow through the second connection port 220B. In FIG. 4, the first port 292A of the refrigerant circuit 290 is closed.

The recovery cylinder(s) 250 can be fluidly connected to the second port 292B of the refrigerant circuit 290. For example, a (fourth) hose 270D can fluidly connect one of the recovery cylinder(s) 250 to the second port 292B of the refrigerant circuit 290. The hose 270D can fluidly connect a third port 252C of the recovery cylinder(s) 250 to the second port 292B of the refrigerant circuit 290. The third port 252C of the recovery cylinder(s) 250 and/or the second port 292B of the refrigerant circuit 290 is closed (e.g., the shutoff valve of the third port 252C is closed, the shutoff valve of the second port 292B is closed) such that refrigerant does not flow through the second port 292B of the refrigerant circuit 290.

In the recovery preparation configuration of FIG. 4, the valves 230A, 230B, 230C, 240 in the transfer circuit 210 fluidly connect both the first connection port 220A and the second connection port 220B to the suction inlet 214 of the vacuum pump 212, within the transfer circuit 210. For example, the first connection port 220A is fluidly connected to the suction inlet 214 of the vacuum pump 212 through the first multiple-way valve 230A and the bypass valve 240. For example, the second connection port 220B is fluidly connected to the suction inlet 214 of the vacuum pump 212 through the first multiple-way valve 230A. The vacuum pump 212 suctions through the first connection port 220A and/or the second connection port 220B (e.g., to evacuate the recovery cylinder(s) 250, to evacuate the heating tank 204). In another embodiment, the second connection port 220B may be fluidly connected to the heating tank 204 (e.g., to evacuate the heating tank 204 directly instead of via the recovery cylinder(s) 250).

In the recovery preparation configuration, the valves 230A, 230B, 230C, 240 in the transfer circuit 210 fluidly connects the discharge outlet 216 of the vacuum pump 212 to the exhaust port 220C, within the transfer circuit 210. For example, the discharge outlet 216 is fluidly connected to the exhaust port 220C by the second multiple-way valve 230B. The vacuum pump 212 discharges through the first connection port 220A into the environment (e.g., into the open air, or the like).

Figure 5:
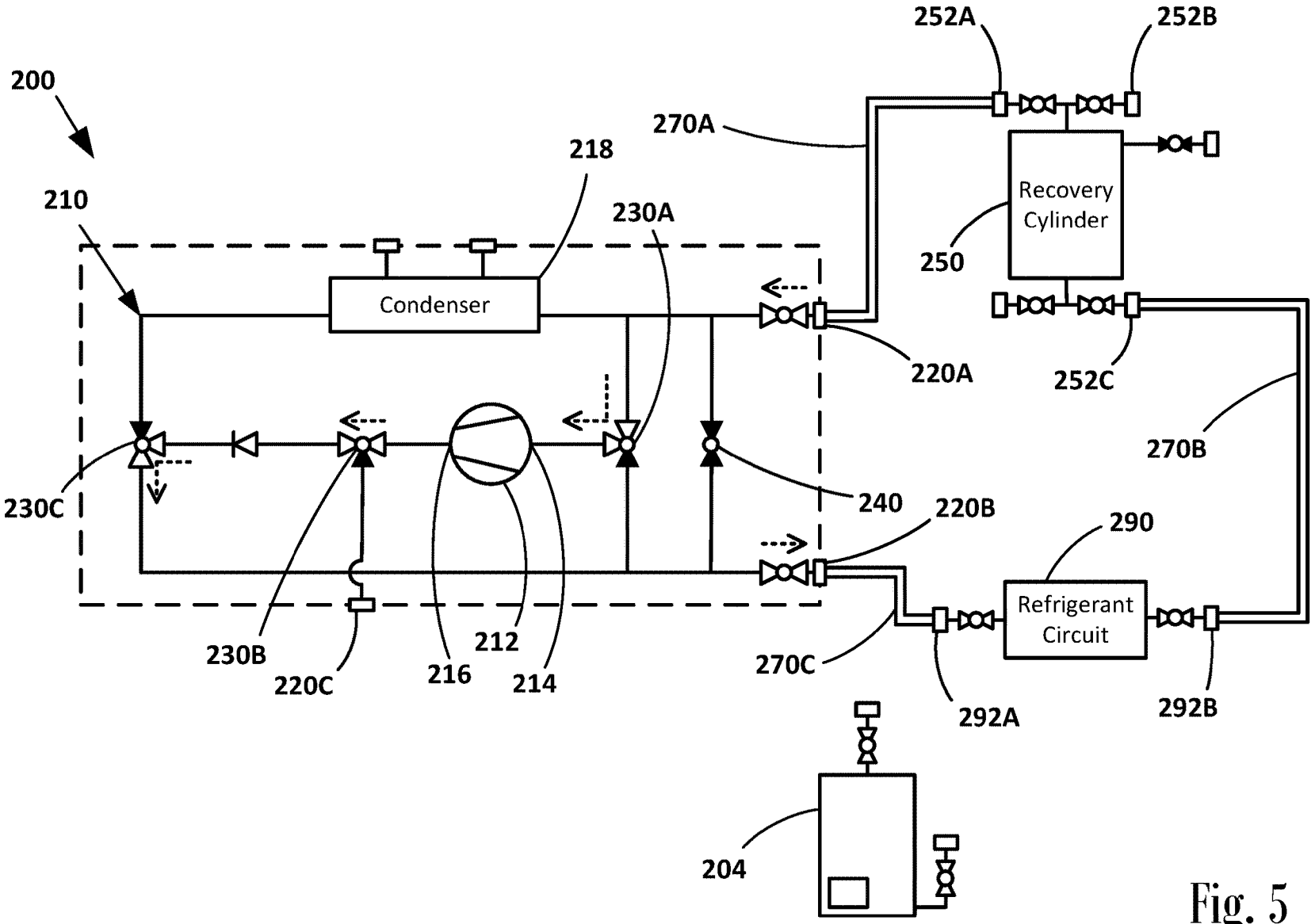
FIG. 5 is a schematic diagram of the refrigerant circuit and the refrigerant recovery system of FIG. 3, with the refrigerant recovery system in a liquid recovery configuration, according to an embodiment.

FIG. 5 shows the refrigerant recovery system 200 in a liquid recovery configuration. In the liquid recovery configuration, the refrigerant recovery system 200 is configured to transfer the liquid refrigerant in the refrigerant circuit 290 from the refrigerant circuit 290 into the recovery cylinder(s) 250. The liquid recovery configuration may also be referred to as a liquid removal configuration, a liquid refrigerant recovery configuration, or a liquid refrigerant removal configuration.

The first connection port 220A of the transfer circuit 210 is fluidly connected to the one or more the recovery cylinder(s) 250. For example, the (first) hose 270A fluidly connects the first connection port 220A of the transfer circuit 210 to the recovery cylinder(s) 250 (e.g., to a first port 252A of a first recovery cylinder 250). The first connection port 220A is fluidly connected to the liquid port 292B of the refrigerant circuit 290 through the recovery cylinder(s) 250. For example, a (second) hose 270B fluidly connects the recovery cylinder 250 to the refrigerant circuit 290 (e.g., fluidly connects the third port 252C of the recovery cylinder 250 to the second/liquid port 292B of the refrigerant circuit 290).

The second connection port 220B of the transfer circuit 210 is fluidly connected to the first port 292A of the refrigerant circuit 290. For example, the (third) hose 270C fluidly connects the second connection port 220B to the first port 292A of the refrigerant circuit 290.

In the recovery preparation configuration, the valves 230A, 230B, 230C, 240 in the transfer circuit 210 fluidly connect the first connection port 220A to the suction inlet 214 of the vacuum pump 212 and fluidly connect the second connection port 220B to the discharge outlet 216 of the vacuum pump 212, within the transfer circuit 210. For example, the first connection port 220A is fluidly connected the suction inlet 214 of the vacuum pump 212 through the first multiple-way valve 230A. For example, the second connection port 220B is fluidly connected the discharge outlet 216 of the vacuum pump 212 through the second multiple-way valve 230B and the third multiple way valve 230C (e.g., in series). The bypass valve 240 is closed. The exhaust port 220C is closed by the second multiple-way valve 230B.

The vacuum pump 212 suctions refrigerant through the first connection port 220A and discharges refrigerant through the second connection port 220B. The suction applied to the recovery cylinder 250 and the discharge applied to the refrigerant circuit 290 causes the liquid working in refrigerant circuit 290 to flow from the refrigerant circuit 290 into the recovery cylinder 250 through the hose 270D. When a plurality of recovery cylinder(s) 250 are used, the recovery cylinders 250 are each filled individually as shown in FIG. 5.

Figure 6:
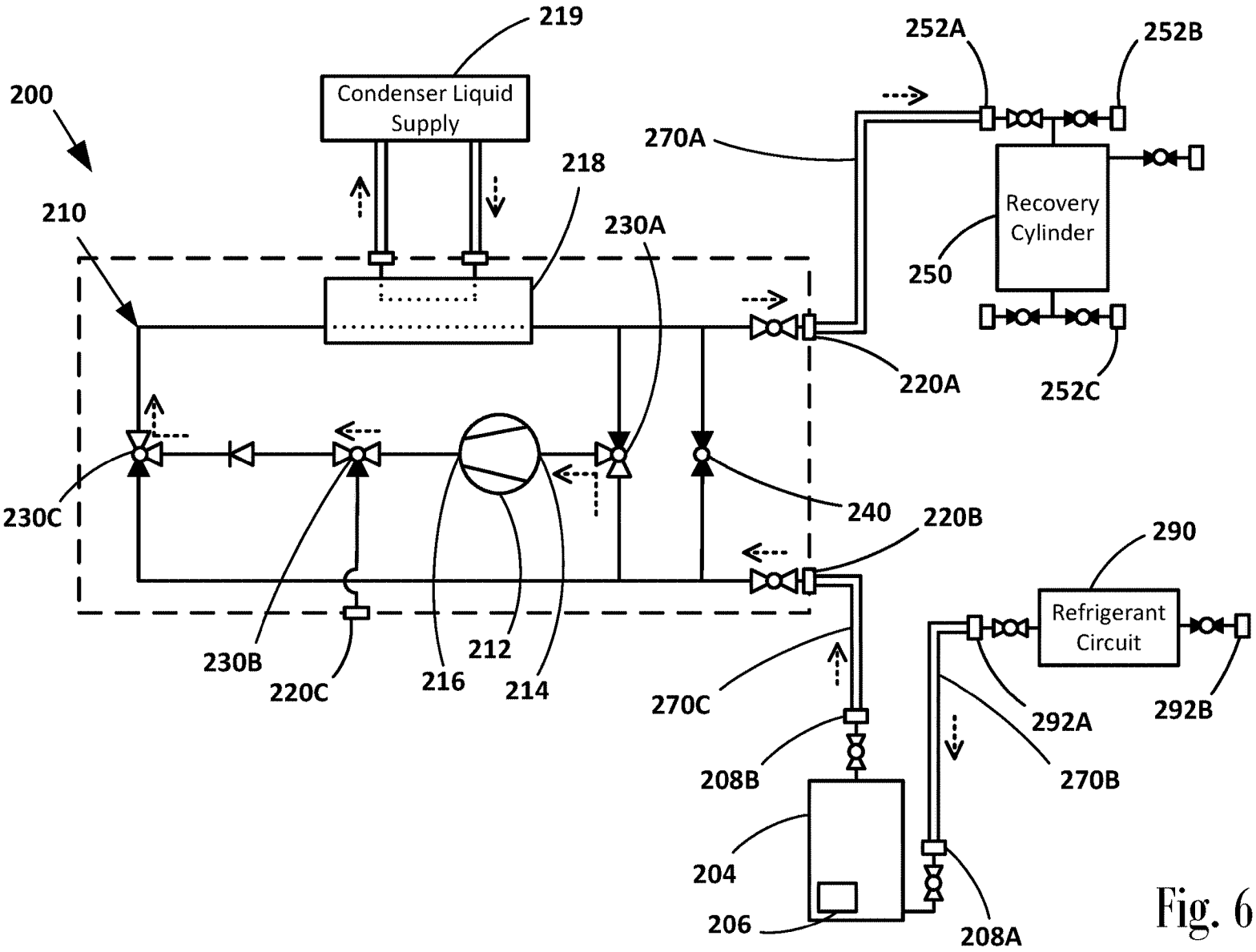
FIG. 6 is a schematic diagram of the refrigerant circuit and the refrigerant recovery system of FIG. 3, with the refrigerant recovery system in a gas recovery configuration, according to an embodiment.

FIG. 6 shows the refrigerant recovery system 200 in a gas recovery configuration. In the gas recovery configuration, the refrigerant recovery system 200 is configured to transfer gaseous refrigerant in the refrigerant circuit 290 from the refrigerant circuit 290 into the recovery cylinder(s) 250. The gas recovery configuration may also be referred to as a gas removal configuration, a gaseous refrigerant recovery configuration, or a gaseous refrigerant removal configuration.

In the gas recovery configuration, the condenser 218 is fluidly connected to a condenser fluid supply 219 configured to circulates a liquid (e.g., water, water mixture, a chiller liquid, intermediate cooling fluid, or the like) through the condenser 218 of the transfer circuit 210. In an embodiment, the condenser fluid supply 219 is a water supply that circulates water through the condenser 218.

The first connection port 220A of the transfer circuit 210 is fluidly connected to the one or more the recovery cylinder(s) 250. For example, the (first) hose 270A fluidly connects the first connection port 220A of the transfer circuit 210 to the recovery cylinder(s) 250 (e.g., to a first port 252A of a first recovery cylinder 250). In this configuration, the other ports of the recovery cylinder 250 are closed.

The second connection port 220B of the transfer circuit 210 is fluidly connected to the first port 292A of the refrigerant circuit 290 through the heating tank 204. For example, the (second) hose 270B fluidly connects the first port 292A of the refrigerant circuit 290 to the heating tank 204 (e.g., to the first port 208A of the heating tank 204), and the (third) hose 270C fluidly connects the second connection port 220B to the heating tank 204 (e.g., to the second port 208A of the heating tank 204). The refrigerant flows from the refrigerant circuit 290 through the heating tank 204 into the second connection port 220B.

The refrigerant flowing from the refrigerant circuit 290 can be in a mixed phase (e.g., a mixture of gaseous and liquid refrigerant). The suction applied to the refrigerant circuit 290 by the refrigerant recovery system 100 (i.e., by the vacuum pump 212) can also cause condensation of the refrigerant. In the gas recovery configuration, the heating tank 204 vaporizes liquid refrigerant in the mixed phase such that no significant amount of liquid refrigerant flows into the transfer circuit 210 and into the vacuum pump 212. The refrigerant flowing into the second connection port 220B of the transfer circuit 210 is gaseous.

In the gas recovery configuration shown in FIG. 6, the valves 230A, 230B, 230C, 240 in the transfer circuit 210 fluidly connect the first connection port 220A to the discharge outlet 216 of the vacuum pump 212 and fluidly connect the second connection port 220B to the suction inlet 214 of the vacuum pump 212, within the transfer circuit 210. In the transfer circuit 210, the first connection port 220A is fluidly connected to the discharge outlet 216 of the vacuum pump 212 through the condenser 218. For example, the first connection port 220A is fluidly connected to the discharge outlet 216 of the vacuum pump 212 via the second multiple-way valve 230B, the third multiple-way valve 230C, and the condenser 218 (e.g., in series). For example, the second connection port 220B is fluidly connected 220A to the suction inlet 214 of the vacuum pump 212 via the first multiple-way valve 230A. The bypass valve 240 is closed. The exhaust port 220C is also closed by the second multiple-way valve 230B.

In FIG. 6, the vacuum pump 212 suctions refrigerant from the refrigerant circuit 290 through the second connection port 220B and discharges refrigerant to the recovery cylinder(s) 250 through the first connection port 220A. The refrigerant is suctioned into the refrigerant circuit in a gaseous phase. The condenser 218 is configured to cool and condense gaseous refrigerant as it flows through the condenser 218. The gaseous refrigerant flows through the second connection port 220B, is condensed in the condenser 218, and is discharged as liquid refrigerant through the first connection port 220A. The refrigerant is discharged into the recovery cylinder(s) 250 in a liquid state. When a plurality of recovery cylinders 250 are used, the recovery cylinders 250 can each be filled individually (e.g., until each reaches its capacity) as shown in FIG. 6.

In an embodiment, the refrigerant recovery system 200 can operate in the gas recovery configuration until the refrigerant circuit 290 is empty. For example, "empty" can refer to a pressure of the residual refrigerant in the refrigerant circuit 290 being at or below a predetermined minimum pressure (e.g., the predetermined minimum pressure is a predetermined pressure for an refrigerant circuit to be considered as empty). In an embodiment, the refrigerant circuit 290 may be considered as "empty" when a pressure of residual refrigerant in the refrigerant circuit 290 is at or about or below 25 mm Hg.

Figure 7:
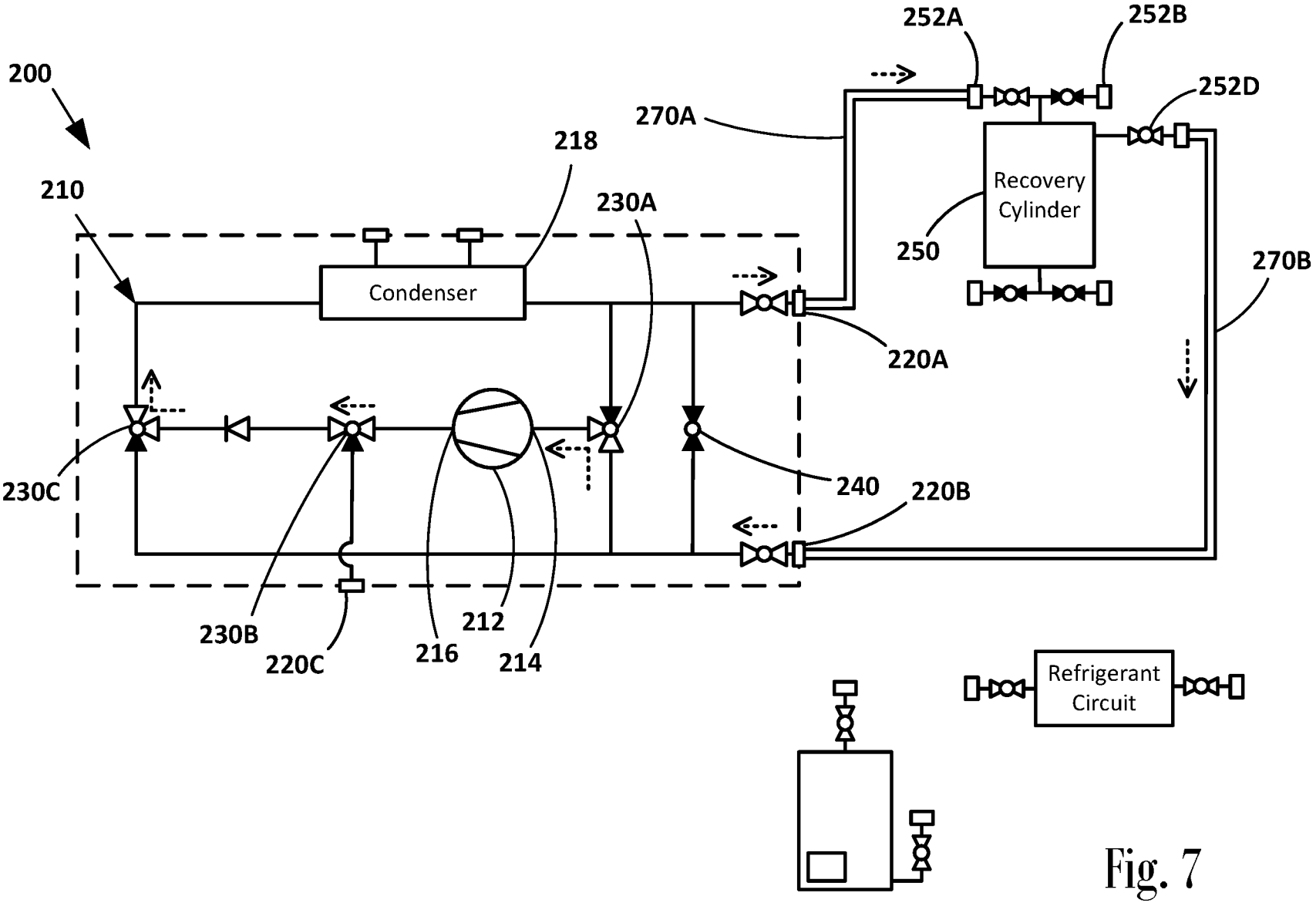
FIG. 7 is a schematic diagram of the refrigerant circuit and the refrigerant recovery system of FIG. 3, with the refrigerant recovery system in a liquid self-evacuation configuration, according to an embodiment.

FIG. 7 shows the refrigerant recovery system 200 in a liquid self-evacuation configuration. In the liquid self-evacuation configuration, the refrigerant recovery system 200 is configured to discharge liquid refrigerant remaining in the transfer circuit 210 into the recovery cylinder(s) 250 (e.g., into the recovery cylinder 250).

The first connection port 220A of the transfer circuit 210 is fluidly connected to the recovery cylinder(s) 250. For example, a (first) hose 270A fluidly connects the first connection port 220A of the transfer circuit 210 to the recovery cylinder(s) 250 (e.g., to a first port 252A of a recovery cylinder 250). The liquid self-evacuation configuration may also discharge any remaining liquid in the hose 270A into the recovery cylinder 250.

The second connection port 220B of the transfer circuit 210 is also fluidly connected to the recovery cylinder(s) 250. As shown in FIG. 7, the second connection port 220B is also connected to the same recovery cylinder as the first connection port 220A. In particular, the second connection port 220B is fluidly connected to a vent port 252D of the recovery cylinder 250. For example, a (second) hose 270B fluidly connects the second connection port 220B to the vent port 252D of the recovery cylinder 250. In the shown embodiment, the vent port 252D is used such that the flow passes through the interior volume of the recovery cylinder 250 (e.g., does not just pass through interconnected valves of the recovery cylinder 250 without passing through the interior volume of the cylinder).

In the liquid self-evacuation configuration of FIG. 7, the valves 230A, 230B, 230C, 240 in the transfer circuit 210 fluidly connect the first connection port 220A to the discharge outlet 216 of the vacuum pump 212 and fluidly connect the second connection port 220B to the suction inlet 214 of the vacuum pump 212, within the transfer circuit 210. For example, the valves 230A, 230B, 230C, 240 in the liquid self-evacuation configuration have the same configuration as in the gas recovery configuration of FIG. 6. The bypass valve 240 is closed. The exhaust port 220C is also closed by the second multiple-way valve 230B.

In FIG. 7, the vacuum pump 212 suctions gaseous refrigerant through the second connection port 220B and discharges liquid/mixed phase refrigerant through the first connection port 220A. For example, the gaseous refrigerant is cycled through the transfer circuit 210 forcing/discharging any remaining liquid refrigerant from the transfer circuit 210 through the first connection port 220A and into the recovery cylinder 250.

FIG. 8 shows the refrigerant recovery system 200 in a gas self-evacuation configuration. In the gas self-evacuation configuration, the refrigerant recovery system 200 is configured to discharge vapor refrigerant remaining in the transfer circuit 210 into the recovery cylinder(s) 250 (e.g., into the recovery cylinder 250).

The first connection port 220A of the transfer circuit 210 is fluidly connected to a closed port 252A of the recovery cylinder(s) 250. For example, the (first) hose 270A fluidly connects the first connection port 220A of the transfer circuit 210 to the closed port 252A of the recovery cylinder(s) 250 (e.g., to a first port 252A of a recovery cylinder 250). The port 252A is closed such that no refrigerant flows through the port 252A (e.g., into the hose 270A). In an embodiment, when a hose includes a shutoff valve (not shown) on its end as discussed above, a hose connected to a closed port (e.g., hose 270A, hose 270B as shown in FIG. 8, or the like) may be disconnected with its shutoff valve closed instead of remaining connected to the closed port.

The second connection port 220B of the transfer circuit 210 is fluidly connected to a closed port 252D of the recovery cylinder(s) 250. As shown in FIG. 8, the second connection port 220B is connected to the same recovery cylinder as the first connection port 220A. In particular, the second connection port 220B is fluidly connected to the vent port 252D of the recovery cylinder 250. For example, the (second) hose 270B fluidly connects the second connection port 220B to the vent port 252D of the recovery cylinder 250.

The exhaust port 220C of the transfer circuit 210 is fluidly connected to the recovery cylinder(s) 250. For example, a hose 270E fluidly connects the exhaust port 220C to the recovery cylinder(s) 250 (e.g., to a second port 252B of a recovery cylinder 250). In an embodiment, the hose 270E is a smaller hose relative to the other hoses 270A, 270B (e.g., hose 270E has a smaller diameter than the other hoses 270A, 270B).

In the gas self-evacuation configuration of FIG. 8, the valves 230A, 230B, 230C, 240 in the transfer circuit 210 fluidly connect both the first connection port 220A and the second connection port 220B to the suction inlet 214 of the vacuum pump 212 and fluidly connect the discharge outlet 216 of the vacuum pump 212 to the exhaust port 220C, within the transfer circuit 210. The bypass valve 240 is open. The first connection port 220A and the second connection port 220B are fluidly connected to the suction inlet 214 of the vacuum pump 212 via the first multiple-way valve 230A and the bypass valve 270. For example, the first connection port 220A is fluidly connected to the suction inlet 214 of the vacuum pump 212 via the first multiple-way valve 230A. For example, the first connection port 220A is fluidly connected to the suction inlet 214 of the vacuum pump 212 via the bypass valve 240 and the first multiple-way valve 230A (e.g., in series, in series in this order). For example, the bypass valve 240 can fluidly connect the first connection port 220A to the second connection port 220B in the refrigerant circuit 220 (e.g., not via the vacuum pump 212). The discharge outlet 216 of the vacuum pump 212 is fluidly connected to the exhaust port 220C via the second multiple-way valve 230B.

In FIG. 8, the vacuum pump 212 discharges residual gaseous refrigerant in the transfer circuit 210 into recovery cylinder 250. When the hoses 270A, 270B remain connected to the connection ports 220A, 220B of the transfer circuit 210 as shown in FIG. 8, residual gaseous refrigerant in the hoses 270A, 270B is also suctioned into the vacuum pump 212 and discharged into the recovery cylinder 250. The hose 270E (relative to the other hoses) can have the smaller volume such that a lesser amount of gaseous refrigerant remains in the hose 270E (relative to using one of the relatively larger hoses 270A, 270B).

After operating the refrigerant recovery system 200 in the gas self-evacuation configuration. The refrigerant recovery system 200 can be disconnected from the recovery cylinder(s) 250. For example, the recovery cart 202 in an embodiment can then be moved/rolled from the HVACR system of the refrigerant circuit 290 (e.g., to the next HVACR system to be serviced). The refrigerant circuit of the refrigerant circuit 290 and can then be serviced as the refrigerant has been removed from the refrigerant circuit.

Figure 9:
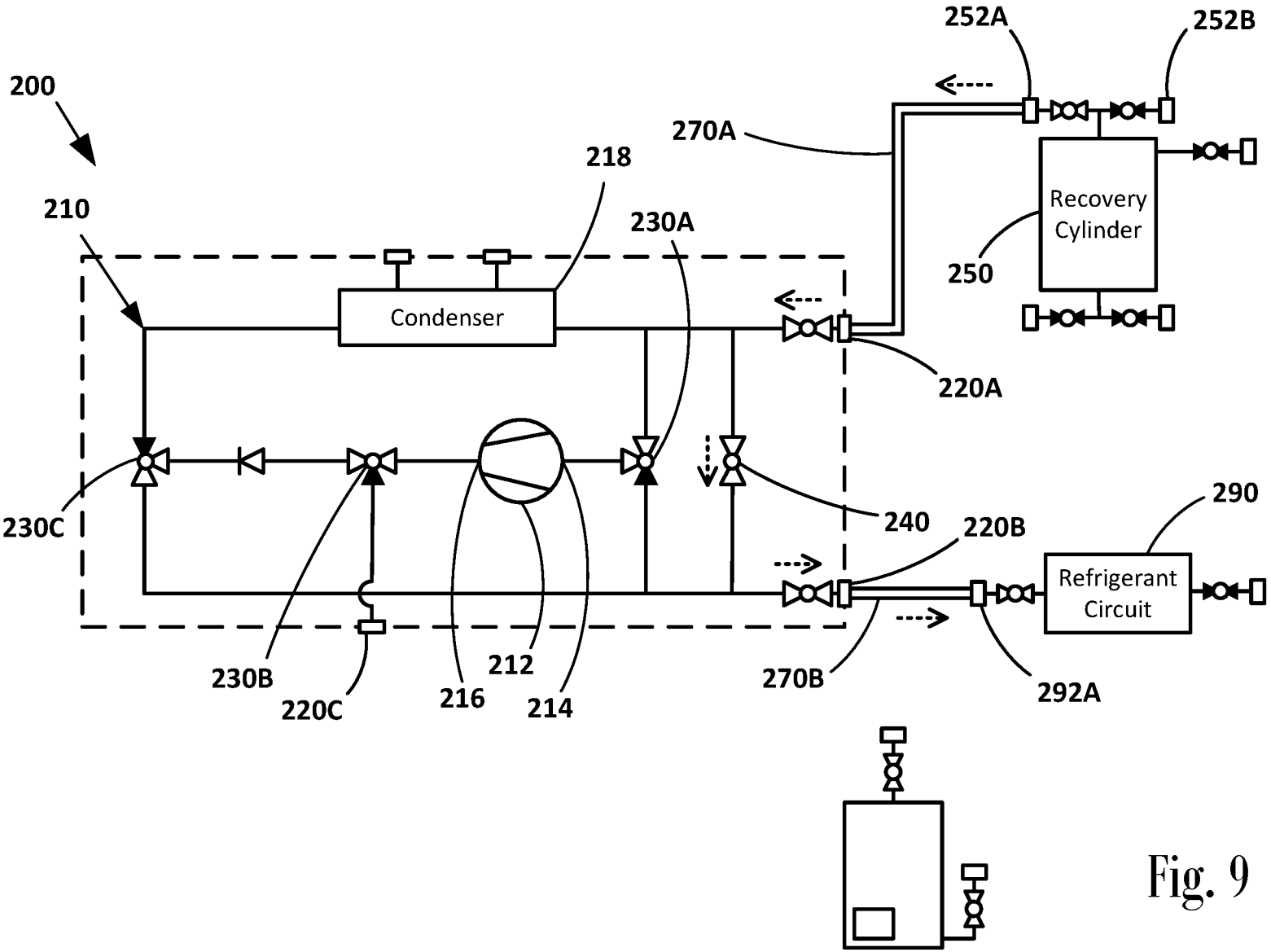
FIG. 9 is a schematic diagram of the refrigerant circuit and the refrigerant recovery system of FIG. 3, with the refrigerant recovery system in a gas charging configuration, according to an embodiment.

FIG. 9 shows the refrigerant recovery system 200 in a gas charging configuration. In the gas charging configuration, the refrigerant recovery system 200 is configured to transfer the gaseous refrigerant in the recovery cylinder(s) 250 from the recovery cylinder(s) 250 into the refrigerant circuit 290. The gas charging configuration may also be referred to as a gas return configuration, a gaseous refrigerant charging configuration, or a gaseous refrigerant return configuration.

The first connection port 220A of the transfer circuit 210 is fluidly connected to the one or more the recovery cylinder(s) 250. For example, a (first) hose 270A fluidly connects the first connection port 220A of the transfer circuit 210 to the recovery cylinder(s) 250 (e.g., to a first port 252A of a first recovery cylinder 250). In this configuration, the other ports of the recovery cylinder 250 can be closed. When the refrigerant from multiple recovery cylinders 250 is being transferred into the refrigerant circuit 290, the multiple recovery cylinders 250 can be connected to each other in series (e.g., a second port 252B of a first recovery cylinder is fluidly connected to a first port 252A of the second recovery cylinder) in a gas charging configuration.

The second connection port 220B of the transfer circuit 210 is fluidly connected to the refrigerant circuit 290. For example, a (second) hose 270B fluidly connects the second connection port 220B to the first port 292A of the refrigerant circuit 290.

In the gas charging configuration of FIG. 9, the valves 230A, 230B, 230C, 240 in the transfer circuit 210 fluidly connect the first connection port 220A to the suction inlet 214 of the vacuum pump 212 and fluidly connect the second connection port 220B to the discharge outlet 216 of the vacuum pump 212, within the transfer circuit 210. For example, the first connection port 220A is fluidly connected to the suction inlet 214 of the vacuum pump 212 via the first multiple-way valve 230A. For example, the second connection port 220B is fluidly connected 220A to the discharge outlet 216 of the vacuum pump 212 via the second multiple-way valve 230B and the third multiple-way valve 230C (e.g., in series). The exhaust port 220C is also closed by the second multiple-way valve 230B.

In FIG. 9, the vacuum pump 212 suctions refrigerant through the first connection port 220A and discharges the refrigerant through the second connection port 220B. The refrigerant recovery system 200 operates in the gas charging configuration to transfer the gaseous refrigerant in the recovery cylinder(s) 250 into the refrigerant circuit 290. In FIG. 9, the refrigerant circuit 290 is empty and evacuated to be at a negative pressure (e.g., below atmospheric pressure, close to −1 atmosphere). The evacuated/negative pressure refrigerant circuit 290 causes refrigerant added to the refrigerant circuit 290 to be a pressure that causes freezing of the process fluid in the refrigerant circuit 290 (e.g., freezing of the process fluid in the evaporator of the refrigerant circuit 290 and/or freezing of the process fluid in the condenser of the refrigerant circuit 290). If refrigerant is added to the refrigerant circuit 290 too quickly, this can cause freezing of the process fluid that damages component(s) in the refrigerant circuit 290 (e.g., burst pipes in the condenser and/or the evaporator of the refrigerant circuit 290).

As shown in FIG. 9, the bypass valve 240 is open, the bypass valve 240 is opened to allow a relatively slower passive flow of the refrigerant through the transfer circuit 210 and into the refrigerant circuit 290 (e.g., without operating the vacuum pump 212). This relatively slower flow of refrigerant into the refrigerant circuit 290 can allow filling of the refrigerant circuit 290 without causing freezing of the process fluids in the refrigerant circuit 290. For example, the refrigerant is allowed to flow into the refrigerant circuit 290 until the pressure in the refrigerant circuit 290 is above a pressure at which the refrigerant is at the freezing point of the process fluid. In an embodiment, the vacuum pump 212 may be used in addition and/or instead of the bypass valve 240 when the vacuum pump 212 is able to provide a flow of the gaseous refrigerant at sufficiently low pressure and rate to not cause freezing in the refrigerant circuit 290.

Figure 10:
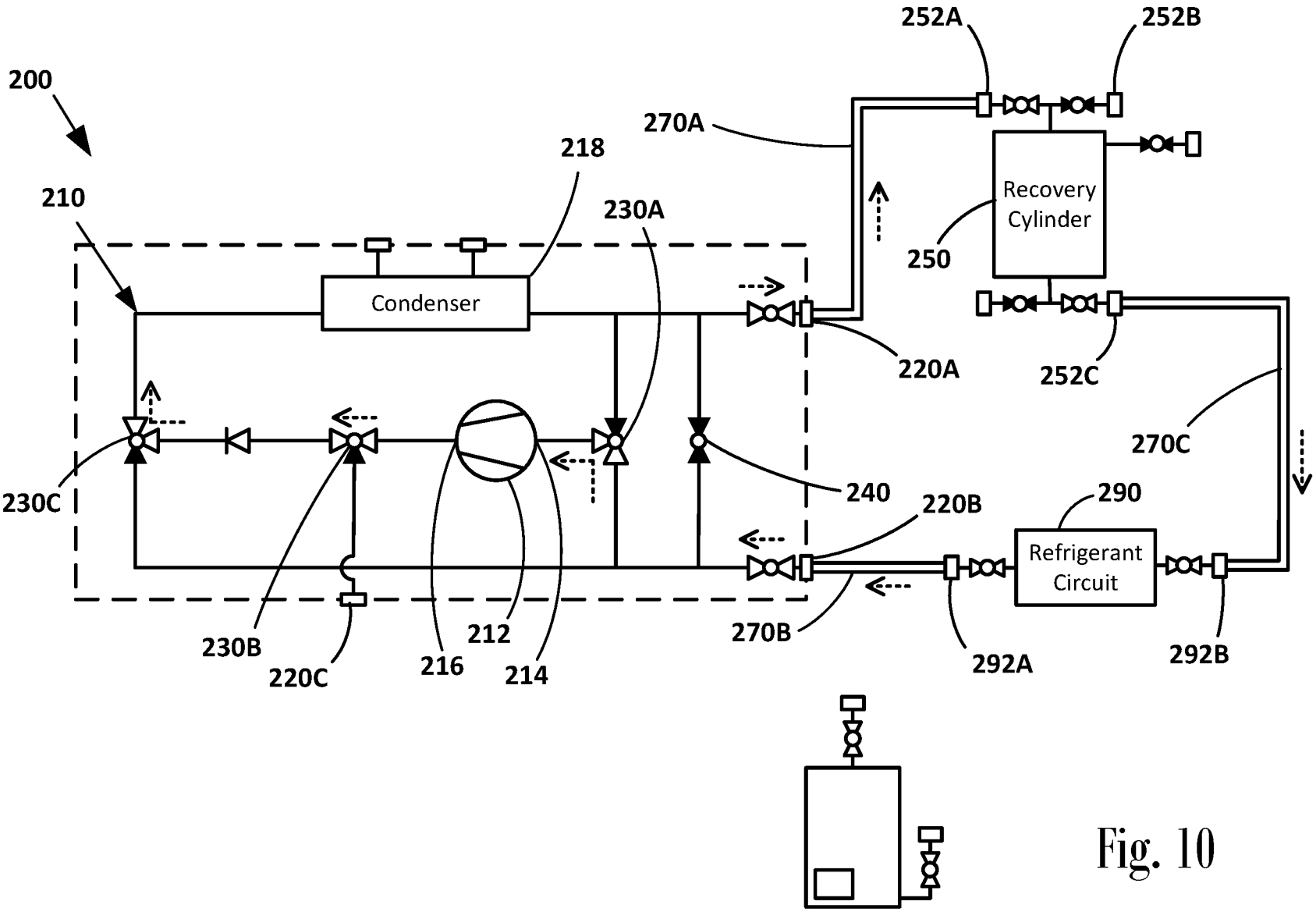
FIG. 10 is a schematic diagram of the refrigerant circuit and the refrigerant recovery system of FIG. 3, with the refrigerant recovery system in a liquid charging configuration, according to an embodiment.

FIG. 10 shows the refrigerant recovery system 200 in a liquid charging configuration. In the liquid charging configuration, the refrigerant recovery system 200 is configured to transfer the liquid refrigerant in the recovery cylinder(s) 250 from the recovery cylinder(s) 250 into the refrigerant circuit 290. The liquid charging configuration may also be referred to as a liquid return configuration, a liquid refrigerant charging configuration, or a liquid refrigerant return configuration.

The first connection port 220A of the transfer circuit 210 is fluidly connected to the one or more the recovery cylinder(s) 250. For example, the (first) hose 270A fluidly connects the first connection port 220A of the transfer circuit 210 to the recovery cylinder(s) 250 (e.g., to a first port 252A of a first recovery cylinder 250). The recovery cylinder(s) 250 are also fluidly connected to the refrigerant circuit 290, such that the first connection port 220A is fluidly connected to the liquid port 292B of the refrigerant circuit 290 through the recovery cylinder(s) 250. For example, a (third) hose 270B fluidly connects the recovery cylinder 250 to the refrigerant circuit 290 (e.g., fluidly connects the third port 252C of the recovery cylinder 250 to the second/liquid port 292B of the refrigerant circuit 290).

The second connection port 220B of the transfer circuit 210 is fluidly connected to the refrigerant circuit 290 (e.g., to the first port 292A of the refrigerant circuit 290). For example, a (second) hose 270B fluidly connects the second connection port 220B to the first port 292A of the refrigerant circuit 290.

When the refrigerant from multiple recovery cylinders 250 is being transferred into the refrigerant circuit 290, the multiple recovery cylinders 250 can be connected to each other in series (e.g., a second port 252B of a first recovery cylinder is fluidly connected to a first port of the second recovery cylinder by another hose) in the liquid charging configuration. For example, the first connection port 220A is fluidly connected (e.g., by the hose 270A) to a first one of the recovery cylinders connected in the series, and the second port 292B of the refrigerant circuit 290 is fluidly connected (e.g., by the hose 270C) to a port 252C of a last one of the recovery cylinders in the series.

In the liquid charging configuration of FIG. 10, the valves 230A, 230B, 230C, 240 in the transfer circuit 210 fluidly connect the first connection port 220A to the discharge outlet 216 of the vacuum pump 212 and fluidly connect the second connection port 220B to the suction inlet 214 of the vacuum pump 212, within the transfer circuit 210. For example, the first connection port 220A is fluidly connected to the discharge outlet 216 of the vacuum pump 212 via the second multiple-way valve 230B and the third multiple-way valve 230C (e.g., in series). For example, the second connection port 220B is fluidly connected 220A to the suction inlet 214 of the vacuum pump 212 via the first multiple-way valve 230A. The bypass valve 240 is closed. The exhaust port 220C is also closed by the second multiple-way valve 230B.

In FIG. 10, the vacuum pump 212 suctions through the second connection port 220B and discharges through the first connection port 220A. The suction applied to the refrigerant circuit 290 and the discharge applied to the recovery cylinder(s) 250 causes the liquid refrigerant in the recovery cylinder(s) 250 to flow from recovery cylinder(s) 250 into the refrigerant circuit 290 through the hose 270C. The refrigerant recovery system 200 operates in the liquid charging configuration to transfer the liquid refrigerant in the recovery cylinder(s) 250 into the refrigerant circuit 290.

Figure 11:
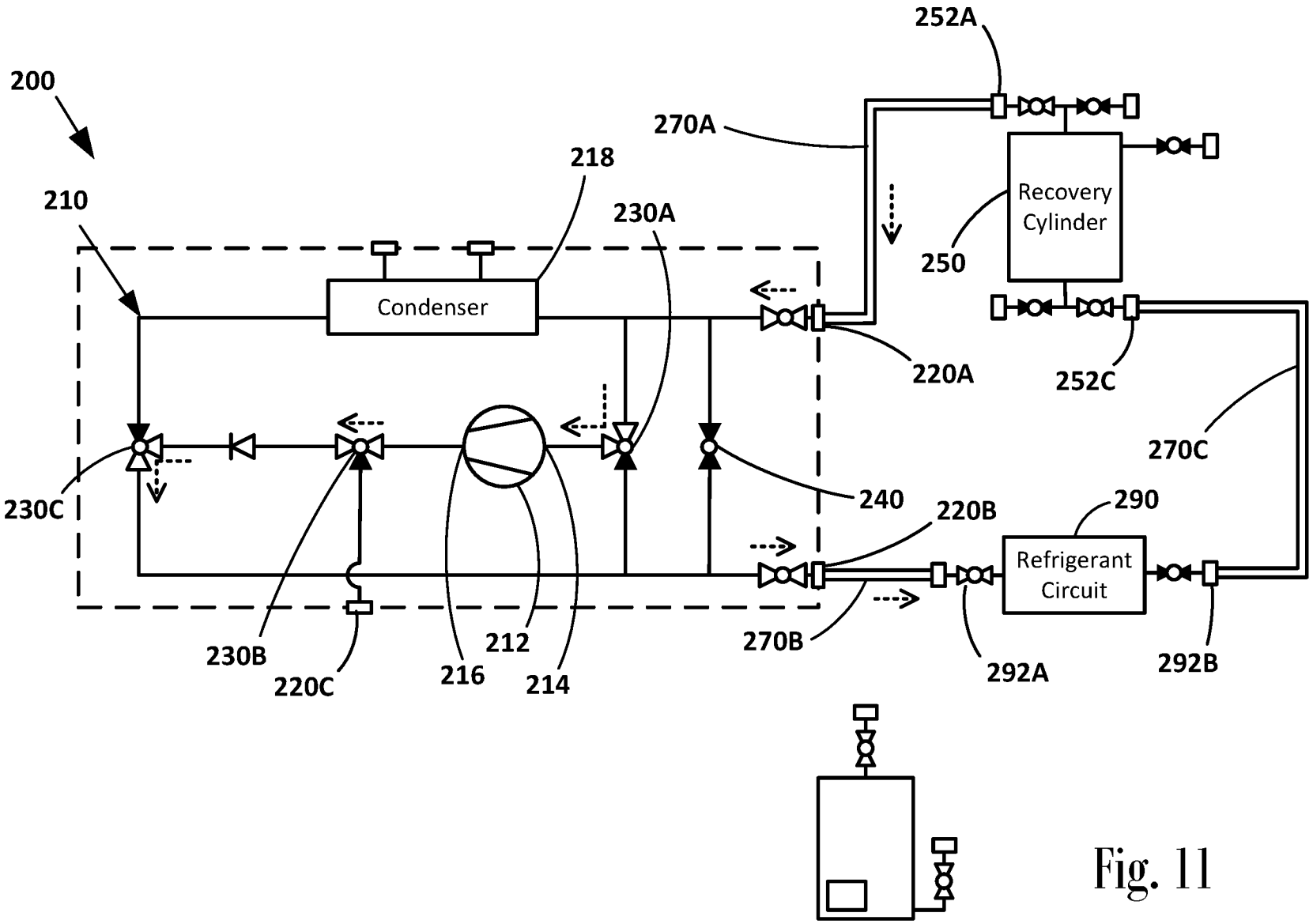
FIG. 11 is a schematic diagram of the refrigerant circuit and the refrigerant recovery system of FIG. 3, with the refrigerant recovery system in a cylinder evacuation configuration, according to an embodiment.

FIG. 11 shows the refrigerant recovery system 200 in a cylinder evacuation configuration. In the cylinder charging configuration, the refrigerant recovery system 200 is configured to transfer the remaining gaseous refrigerant in the recovery cylinder(s) 250 from the recovery cylinder(s) 250 into the refrigerant circuit 290.

The first connection port 220A of the transfer circuit 210 is fluidly connected to the one or more the recovery cylinder(s) 250. For example, the (first) hose 270A fluidly connects the first connection port 220A of the transfer circuit 210 to the recovery cylinder(s) 250 (e.g., to a first port 252A of a first recovery cylinder 250). The second connection port 220B of the transfer circuit 210 is fluidly connected to the refrigerant circuit 290 (e.g., to the first port 292A of the refrigerant circuit 290). For example, a (second) hose 270B fluidly connects the second connection port 220B to the first port 292A of the refrigerant circuit 290.

The (third) hose 270B can also be fluidly connected to the recovery cylinder(s) 250 (e.g., to the port 252C of the recovery cylinder 250). For example, the hose 270B fluidly connects the recovery cylinder(s) 250 to the closed second port 292B of the refrigerant circuit 290.

When the refrigerant from multiple recovery cylinders 250 was transferred into the refrigerant circuit 290, the multiple recovery cylinders 250 can be connected to each other in series (e.g., a second port 252B of a first recovery cylinder is fluidly connected to a first port of the second recovery cylinder by another hose) in the liquid charging configuration. For example, the first connection port 220A is fluidly connected (e.g., by the hose 270A) to a first one of the recovery cylinders connected in the series.

In the cylinder evacuation configuration of FIG. 11, the valves 230A, 230B, 230C, 240 in the transfer circuit 210 fluidly connect the first connection port 220A to the suction inlet 214 of the vacuum pump 212 and fluidly connect the second connection port 220B to the discharge outlet 216 of the vacuum pump 212, within the transfer circuit 210. For example, the first connection port 220A is fluidly connected to the suction inlet 214 of the vacuum pump 212 via the first multiple-way valve 230A. For example, the second connection port 220B is fluidly connected 220A to the discharge outlet 216 of the vacuum pump 212 via the second multiple-way valve 230B and the third multiple-way valve 230C. The bypass valve 240 is closed. The exhaust port 220C is also closed by the second multiple-way valve 230B.

In FIG. 11, the vacuum pump 212 applies suction through the first connection port 220A and discharges through the first connection port 220A. The refrigerant recovery system 200 suctions and discharges any remaining refrigerant in the recovery cylinder(s) 250 into the refrigerant circuit 290, refrigerant in the transfer circuit 210 and the hoses 270A, 270B, 270C can also be discharged into the refrigerant circuit 290. The refrigerant recovery system 200 operates in the cylinder evacuation configuration to transfer any remaining refrigerant in the recovery cylinder(s) 250 into the refrigerant circuit 290. The refrigerant recovery system 200 can operate in the cylinder evacuation configuration until the recovery cylinder(s) 250 are empty. For example, "empty" can refer to a pressure of the residual refrigerant in the recovery cylinder(s) 250 being at or below a predetermined minimum pressure (e.g., the predetermined minimum pressure is a predetermined pressure for a vessel or cylinder to be considered as empty). In an embodiment, the recovery cylinder(s) 250 may be considered as "empty" when a pressure of residual refrigerant in the recovery cylinder(s) 250 is at or about or below 25 mm Hg (e.g., similar to the refrigerant circuit 290). In an embodiment, the predetermined minimum pressure for being considered empty may be different for the recovery cylinder(s) 250 and for the refrigerant circuit 290.

Figure 12:
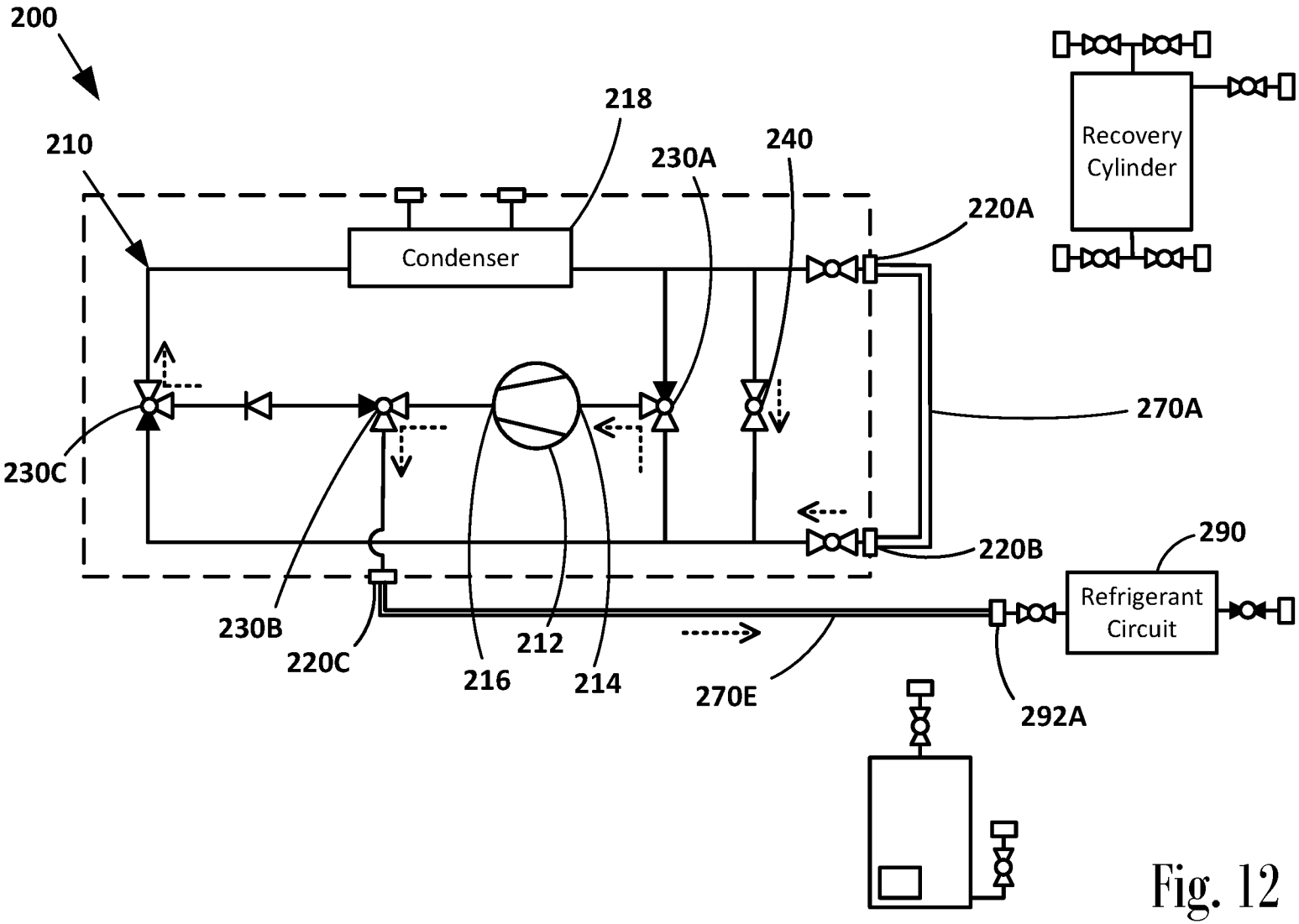
FIG. 12 is a schematic diagram of the refrigerant circuit and the refrigerant recovery system of FIG. 3, with the refrigerant recovery system in a circuit self-evacuation configuration, according to an embodiment.

FIG. 12 shows the refrigerant recovery system 200 in a circuit self-evacuation configuration. In the system evacuation configuration, the refrigerant recovery system 200 is configured to transfer the remaining gaseous refrigerant in refrigerant recovery system 200 into the refrigerant circuit 290.

The first connection port 220A and the second connection port 220B are not connected to external equipment (e.g., to the refrigerant circuit 290 and/or the recovery cylinder(s) 250). The first connection port 220A of the transfer circuit 210 can be fluidly connected to second connection port 220B via a (first) hose 270A.

The exhaust port 220C of the transfer circuit 210 is fluidly connected to the refrigerant circuit 290. For example, the (fifth) hose 270E fluidly connects the exhaust port 220C of the transfer circuit 210 to the refrigerant circuit 290 (e.g., to the first port 292A of the refrigerant circuit 290). The hose 270E can be a smaller hose as discussed previously.

In the circuit self-evacuation configuration of FIG. 12, the valves 230A, 230B, 230C, 240 in the transfer circuit 210 fluidly connect both the first connection port 220A and the second connection port 220B to the suction inlet 214 of the vacuum pump 212 and fluidly connect the exhaust port 220C to the discharge outlet 216 of the vacuum pump 212, within the transfer circuit 210. The bypass valve 240 is open. For example, the first connection port 220A and the second connection port 220B are both fluidly connected to the suction inlet 214 of the vacuum pump 212 via the first multiple-way valve 230A. For example, the exhaust port 230 is fluidly connected to the discharge outlet 216 of the vacuum pump 212 via the second multiple-way valve 230B. The condenser 218 is also fluidly connected to the suction inlet 214 of the vacuum pump 212 (e.g., via the first multiple-way valve 230A).

In FIG. 12, the vacuum pump 212 discharges through the exhaust port 220C. The refrigerant recovery system 200 in FIG. 12 is configured to discharge any remaining refrigerant in the transfer circuit 210 into the refrigerant circuit 290. In an embodiment, refrigerant recovery system 200 may operate in the system evacuation configuration (e.g., to activate the vacuum pump 212) when the refrigerant circuit 290 is operating. For example, this can minimize a pressure in the refrigerant circuit 290 into which the refrigerant is being evacuated, which can help with minimizing refrigerant remaining in the transfer circuit 210.

The multiple-way valves 230A, 230B, 230B have different configurations in the different configurations of the refrigerant recovery system 200. Each configuration of the refrigerant recovery system 200 has a configuration of the multiple-way valves 230A, 230B, 230B (e.g., positions the valves 230A, 230B, 230B) that determines how the connection ports 230A, 230B, 230C each fluidly connect to the vacuum pump 212. For example, the configurations of the refrigerant recovery system 200 in FIGS. 2 and 8 have the multiple-way valves 230A, 230B, 230C in a first configuration. For example, the configurations of the refrigerant recovery system 200 in FIGS. 6, 7, and 10 has the multiple-way valves 230A, 230B, 230C in a second configuration. For example, the configurations of the refrigerant recovery system 200 in FIGS. 1, 5, and 9 have the multiple-way valves 230A, 230B, 230C in a third configuration. The first, second, and third configurations of the multiple-way valves 230A, 230B, 230C being different from each other.

Figure 13:
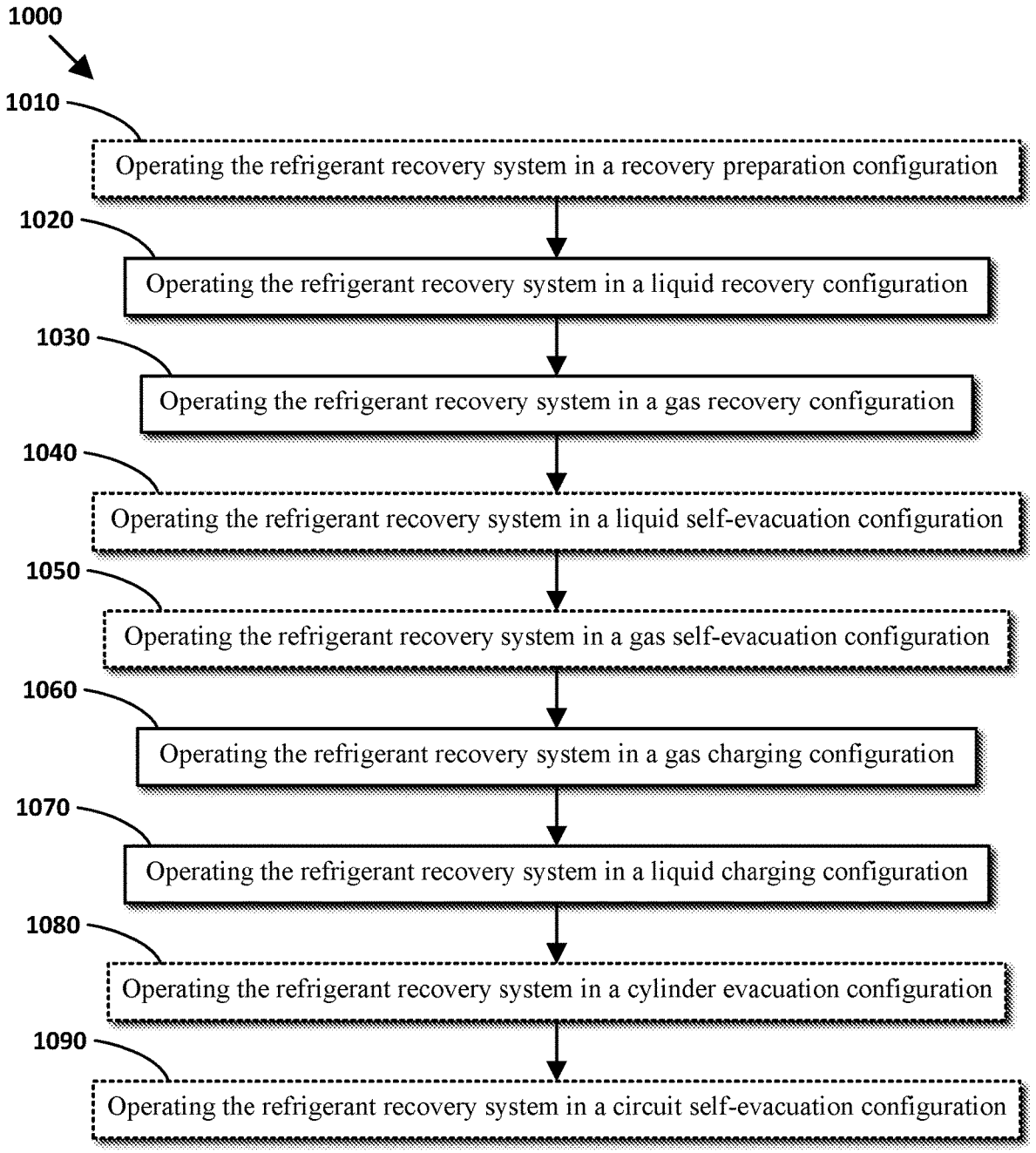
FIG. 13 is a block flow diagram of an embodiment of a method of recovering refrigerant from a refrigerant circuit using a refrigerant recovery system.

FIG. 13 is a block flow diagram of a method 1000 of recovering refrigerant from a refrigerant circuit using a refrigerant recovery system. In an embodiment, the method 100 may be for recovering the refrigerant from the refrigerant circuit 100 of the HVACR system 100 in FIG. 1. In an embodiment, the method can use the refrigerant recovery system 200 in FIG. 3. For example, the method 100 in an embodiment may operate the refrigerant recovery system as shown in FIGS. 4-12 and described above for the refrigerant recovery system 200. The refrigerant recovery system including a transfer circuit (e.g., transfer circuit 210) with a vacuum pump (e.g., vacuum pump 212), a first connection port (e.g., first connection port 220A), a second connection port (e.g., second connection port 220B), an exhaust port (e.g., exhaust port 220C), and a plurality of multiple-way valves (e.g., first multiple-way valve 230A, second multiple-way valve 230B, third multiple-way valve 230C). The refrigerant recovery system recovers/stores the refrigerant in one or more recovery cylinders (e.g., refrigerant cylinder(s) 250). The method 1000 starts at 1010.

At 1010, the refrigerant recovery system operates in a recovery preparation configuration. Operating in the recovery preparation configuration 1010 can include adjusting the multiple-way valves to be in the recovery preparation configuration (e.g., as shown in FIG. 4). Operating in the recovery preparation configuration 1010 can include the vacuum pump suctioning from the recovery cylinder(s) and discharging into the environment. In an embodiment, operating in the recovery preparation configuration at 1010 is as described above for operation of refrigerant recovery system 200 in FIG. 4. The method 1000 then proceeds to 1020.

At 1020, the refrigerant recovery system operates in a liquid recovery configuration. Operating in the liquid recovery configuration 1020 can include adjusting the multiple-way valves (e.g., to be in the positions as shown in FIG. 5 and described above for FIG. 5, adjusted from their positions as shown in FIG. 4 to their positions as shown in FIG. 5). Operating in the liquid recovery configuration 1020 can include the vacuum pump suctioning from the recovery cylinder(s) and discharging into refrigerant circuit. In an embodiment, operating in the liquid recovery configuration at 1020 is as described above for the operation of the refrigerant recovery system 200 in FIG. 5. The method 1000 then proceeds to 1030.

At 1030, the refrigerant recovery system operates in a gas recovery configuration. Operating in the gas recovery configuration 1030 can include adjusting the multiple-way valves (e.g., to be in the positions as shown in FIG. 6 and described above for FIG. 6, adjusted from their positions as shown in FIG. 5 to their positions as shown in FIG. 6). Operating in the gas recovery configuration 1030 can include the vacuum pump suctioning from the refrigerant circuit and discharging into the recovery cylinder(s). For example, the vacuum pump suctions from the refrigerant circuit via a heating tank (e.g., heating tank 204) of the refrigerant recovery system. In an embodiment, operating in the gas recovery configuration at 1030 is as described above for the operation of the refrigerant recovery system 200 in FIG. 6. The method 1000 then proceeds to 1040.

At 1040, the refrigerant recovery system operates in a liquid self-evacuation configuration. Operating in the liquid self-evacuation configuration 1040 can include adjusting the multiple-way valves (e.g., to be in the positions as shown in FIG. 7 and described above for FIG. 7, adjusted from their positions as shown in FIG. 6 to their positions as shown in FIG. 7). Operating in the liquid self-evacuation configuration 1040 can include the vacuum pump suctioning from the recovery cylinder(s) and discharging into the recovery cylinder(s). For example, the vacuum pump suctions from a vent port (e.g., vent port 252D) of the recovery cylinder(s). In an embodiment, operating in the liquid self-evacuation configuration at 1040 is as described above for the operation of the refrigerant recovery system 200 in FIG. 7. The method 1000 then proceeds to 1050.

At 1050, the refrigerant recovery system operates in a gas self-evacuation configuration. Operating in the gas self-evacuation configuration 1050 can include adjusting the multiple-way valves (e.g., to be in the positions as shown in FIG. 8 and described above for FIG. 8, adjusted from their positions as shown in FIG. 7 to their positions as shown in FIG. 8). Operating in the gas self-evacuation configuration 1050 can include the vacuum pump suctioning from the recovery cylinder(s) and discharging into the recovery cylinder(s). For example, the vacuum pump discharged through the exhaust port of the refrigerant circuit into the recovery cylinder(s). In an embodiment, operating in the gas self-evacuation configuration at 1050 is as described above for the operation of the refrigerant recovery system 200 in FIG. 8. The method 1000 then proceeds to 1060.

At 1060, the refrigerant recovery system operates in a gas charging configuration. Operating in the gas charging configuration 1060 can include adjusting the multiple-way valves (e.g., to be in the positions as shown in FIG. 9 and described above for FIG. 9, adjusted from their positions as shown in FIG. 8 to their positions as shown in FIG. 9). Operating in the gas charging configuration 1060 can include the vacuum pump suctioning from the recovery cylinder(s) and discharging into the refrigerant circuit. In an embodiment, operating in the gas charging configuration 1060 can have an earlier portion and a later portion. In the earlier portion, a bypass valve (e.g., bypass valve 240) in the transfer circuit is open without operating the vacuum pump, to allow a portion of the gaseous refrigerant in the recovery cylinders to passively flow through the transfer circuit and into refrigerant circuit. In the later portion, the bypass valve is closed and the vacuum pump is active to suction gaseous refrigerant from the recovery cylinder(s) and discharge into the refrigerant circuit. In an embodiment, operating in the gas charging configuration at 1060 is as described above for the operation of the refrigerant recovery system 200 in FIG. 9. The method 1000 then proceeds to 1070.

At 1070, the refrigerant recovery system operates in a liquid charging configuration. Operating in the liquid charging configuration 1070 can include adjusting the multiple-way valves (e.g., to be in the positions as shown in FIG. 10 and described above for FIG. 10, adjusted from their positions as shown in FIG. 9 to their positions as shown in FIG. 10). Operating in the liquid charging configuration 1070 can include the vacuum pump suctioning from the refrigerant circuit and discharging into recovery cylinder(s). For example, this causes the liquid refrigerant in recovery cylinder(s) to flow into the refrigerant circuit via a hose (e.g., hose 270C). In an embodiment, operating in the liquid charging configuration at 1070 is as described above for the operation of the refrigerant recovery system 200 in FIG. 10. The method 1000 then proceeds to 1080.

At 1080, the refrigerant recovery system operates in a cylinder evacuation configuration. Operating in the cylinder evacuation configuration 1080 can include adjusting the multiple-way valves (e.g., to be in the positions as shown in FIG. 11 and described above for FIG. 11, adjusted from their positions as shown in FIG. 10 to their positions as shown in FIG. 11). Operating in the cylinder evacuation configuration 1080 can include the vacuum pump suctioning from the recovery cylinder(s) and discharging into the refrigerant circuit. For example, the recovery cylinder(s) and the refrigerant circuit are not fluidly connected separate from the transfer circuit such said suctioning and discharging does not cause transfer refrigerant from the refrigerant circuit into the recovery cylinder(s). In an embodiment, operating in the cylinder evacuation configuration at 1080 is as described above for the operation of the refrigerant recovery system 200 in FIG. 11. The method 1000 then proceeds to 1090.

At 1090, the refrigerant recovery system operates in a circuit self-evacuation configuration. Operating in the circuit self-evacuation configuration 1090 can include adjusting the multiple-way valves (e.g., to be in the positions as shown in FIG. 12 and described above for FIG. 12, adjusted from their positions as shown in FIG. 11 to their positions as shown in FIG. 12). Operating in the circuit self-evacuation configuration 1090 can include the vacuum pump discharging into the refrigerant circuit (e.g., without suctioning from the recovery cylinders and/or the refrigerant circuit). In an embodiment, operating in in the circuit self-evacuation configuration 1090 is as described above for the operation of the refrigerant recovery system 200 in FIG. 12.

The method 1000 is configured to recover refrigerant while ensuring a minimal amount of refrigerant remains in the recovery system and/or in the recovery cylinders. In an embodiment, residual refrigerant in the recovery system and/or in the recovery cylinder may not be of significant concern (e.g., recovery system and/or recovery cylinder(s) always being used for the same type/composition of refrigerant). In an embodiment, the recovery cylinder(s) may have been evacuated previously (e.g., after being used previously). In such embodiments, the method 1000 may omit one or more of 1010, 1040, 1050, 1080, 1090. It should be appreciated that the method 1000 may be modified to include features based on the refrigerant recovery system 200 in FIGS. 2-12. For example, the method 1000 in an embodiment may include connecting and/or disconnecting the hoses (e.g., hose 270A, hose 270B, hose 270C, hose 270D) of the refrigerant recovery system in the different operations of the method 1000 such that the hoses provide the connections as described above (and shown in FIGS. 4-12) for the refrigerant recovery system 200.

Aspects:

Any of Aspects 1-10 may be combined with any of Aspects 11-20.

Aspect 1. A refrigerant recovery system, comprising: a transfer circuit including: a vacuum pump including a suction inlet and a discharge outlet, a plurality of ports including a first connection port, a second connection port, and an exhaust port, and a plurality of multiple-way valves selectively fluidly connecting the first connection port, the second connection port, and the exhaust port to the vacuum pump and having: a first configuration that fluidly connects the first connection port to the suction inlet of the vacuum pump and fluidly connects the second connection port to the discharge outlet of the vacuum pump, a second configuration that fluidly connects the first connection port to the discharge outlet of the vacuum pump and fluidly connects the second connection port to the suction inlet of the vacuum pump, and a third configuration that fluidly connects the suction inlet of the vacuum pump to each of the first connection port and the second connection port and fluidly connects the discharge outlet to the exhaust port.

Aspect 2. The refrigerant recovery system of Aspect 1, further comprising: a refrigerant recovery cart including the transfer circuit.

Aspect 3. The refrigerant recovery system of any one of Aspects 1-2, further comprising: a heating tank configured to evaporate liquid refrigerant prior to flowing into the transfer circuit.

Aspect 4. The refrigerant recovery system of any one of Aspects 1-3, wherein the second configuration is a liquid recovery configuration for recovering liquid refrigerant from the refrigerant circuit.

Aspect 5. The refrigerant recovery system of any one of Aspects 1-4, wherein the transfer circuit includes a bypass valve configured to selectively connect the first connection port and the second connection port.

Aspect 6. The refrigerant recovery system of any one of Aspects 1-5, wherein the transfer circuit includes a condenser, and in the second configuration, the discharge outlet of the vacuum pump is fluidly connected to the first connection port via the condenser, the second configuration being a gaseous refrigerant recovery configuration.

Aspect 7. The refrigerant recovery system of any one of Aspects 1-6, wherein in the first configuration, the vacuum pump is configured to suction gaseous refrigerant into the transfer circuit through the second connection port and to discharge liquid refrigerant from the transfer circuit through the first connection port, the gaseous refrigerant flowing from the vacuum pump to the first connection port being condensed, by the condenser, into the liquid refrigerant.

Aspect 8. The refrigerant recovery system of any one of Aspects 1-7, wherein in the third configuration, the vacuum pump is configured to discharge remaining refrigerant in the transfer circuit through the exhaust port.

Aspect 9. The refrigerant recovery system of any one of Aspects 1-8, wherein the plurality of multiple-way valves includes three or more of the multiple-way valves.

Aspect 10. The refrigerant recovery system of any one of Aspects 1-9, wherein the plurality of multiple-way valves includes two or more three-way valves.

Aspect 11. A method of recovering refrigerant from a refrigerant circuit using a refrigerant recovery system, the refrigerant recovery system including a transfer circuit with a vacuum pump, a first connection port, a second connection port, an exhaust port, and a plurality of multiple-way valves, the method comprising: operating the refrigerant recovery system in a liquid recovery configuration to transfer liquid refrigerant in the refrigerant circuit into one or more recovery cylinders, which includes: adjusting the plurality of multiple-way valves such that a discharge outlet of the vacuum pump is fluidly connected to the refrigerant circuit via the second connection port and a suction inlet of the vacuum pump is fluidly connected to the one or more recovery cylinders via the first connection port, and the vacuum pump suctioning from the one or more recovery cylinders and discharging into the refrigerant circuit; and operating the refrigerant recovery system in a gas recovery configuration to transfer gaseous refrigerant in the refrigerant circuit into the one or more recovery cylinders, which includes: adjusting the plurality of multiple-way valves such that the discharge outlet of the vacuum pump is fluidly connected to the one or more recovery cylinders via the first connection port and the suction inlet of the vacuum pump is fluidly connected to the refrigerant circuit via the second connection port, and the vacuum pump suctioning from the refrigerant circuit and discharging into the one or more recovery cylinders.

Aspect 12. The method of Aspect 11, wherein the operating of the refrigerant recovery system in the liquid recovery configuration includes fluidly connecting the one or more recovery cylinders to the refrigerant circuit with a hose, and the vacuum pump suctioning from the one or more recovery cylinders and discharging into the refrigerant circuit causes the liquid refrigerant to flow through the hose from the refrigerant circuit to the one or more recovery cylinders.

Aspect 13. The method of any one of Aspects 11-12, wherein the transfer circuit includes a condenser, in the gas recovery configuration, the discharge outlet of the vacuum pump is fluidly connected to the first connection port via the condenser, and the transferring of the gaseous refrigerant in the refrigerant circuit from the refrigerant circuit into the one or more recovery cylinders includes condensing, with the condenser, the gaseous refrigerant into liquid refrigerant as the gaseous refrigerant flows through the transfer circuit.

Aspect 14. The method of any one of Aspects 11-13, wherein the refrigerant recovery system includes a heating tank, in the gas recovery configuration, the second connection port is fluidly connected to the refrigerant circuit via the heating tank, and the operating of the refrigerant recovery system in the gas recovery configuration includes evaporating, with the heating tank, liquid refrigerant mixed with the gaseous refrigerant suctioned from the refrigerant circuit.

Aspect 15. The method of any one of Aspects 11-14, further comprising: operating the refrigerant recovery system in a gas charging configuration to transfer the gaseous refrigerant in the one or more recovery cylinders into the refrigerant circuit; and operating the refrigerant recovery system in a liquid charging configuration to transfer the liquid refrigerant in the one or more recovery cylinders into the refrigerant circuit.

Aspect 16. The method of any one of Aspects 11-15, wherein the refrigerant recovery system includes a refrigerant recovery cart with the transfer circuit.

Aspect 17. The method of any one of Aspects 11-16, wherein the transfer circuit includes a bypass valve configured to selectively connect the first connection port and the second connection port, the bypass valve being closed in the liquid recovery configuration and in the gas recovery configuration.

Aspect 18. The method of any one of Aspects 11-17, wherein the transfer circuit includes a bypass valve, and the method further comprises: operating the refrigerant recovery system in a gas self-evacuation configuration, which includes: adjusting the plurality of multiple-way valves and the bypass valve such that the suction inlet of the vacuum pump is fluidly connected to both the first connection port and the second connection port and the discharge outlet of the vacuum pump is fluidly connected to the exhaust port, within the transfer circuit, discharging the gaseous refrigerant remaining in the transfer circuit into the one or more recovery cylinders via the exhaust port.

Aspect 19. The method of any one of Aspects 11-18, wherein the plurality of multiple-way valves includes three or more of the multiple-way valves.

Aspect 20. The method of any one of Aspects 11-19, wherein the plurality of multiple-way valves includes two or more three-way valves.

The terminology used herein is intended to describe particular embodiments and is not intended to be limiting. The terms "a," "an," and "the" include the plural forms as well, unless clearly indicated otherwise. The terms "comprises" and/or "comprising," when used in this Specification, specify the presence of the stated features, integers, steps, operations, elements, and/or components, but do not preclude the presence or addition of one or more other features, integers, steps, operations, elements, and/or components. In an embodiment, "fluidly connected", "fluidly connecting", and "fluidly connects" as described herein can refer to being "fluidly directly connected", "fluidly directly connecting", and "fluidly directly connects", respectively.

With regard to the preceding description, it is to be understood that changes may be made in detail, especially in matters of the construction materials employed and the shape, size, and arrangement of parts without departing from the scope of the present disclosure. This Specification and the embodiments described are exemplary only, with the true scope and spirit of the disclosure being indicated by the claims that follow.

What is claimed is:

1. A refrigerant recovery system, comprising:

a transfer circuit including:

a vacuum pump including a suction inlet and a discharge outlet, a plurality of ports including a first connection port, a second connection port, and an exhaust port, and a plurality of multiple-way valves selectively connecting the first connection port, the second connection port, and the exhaust port to the vacuum pump and having:

a first configuration that fluidly connects the first connection port to the suction inlet of the vacuum pump, and fluidly connects the second connection port to the discharge outlet of the vacuum pump, a second configuration that fluidly connects the first connection port to the discharge outlet of the vacuum pump, and fluidly connects the second connection port to the suction inlet of the vacuum pump, and a third configuration that fluidly connects the suction inlet of the vacuum pump to each of the first connection port and the second connection port, and fluidly connects the discharge outlet to the exhaust port.

2. The refrigerant recovery system of claim 1, further comprising:

a refrigerant recovery cart including the transfer circuit.

3. The refrigerant recovery system of claim 1, further comprising:

a heating tank configured to evaporate liquid refrigerant prior to flowing into the transfer circuit.

4. The refrigerant recovery system of claim 1, wherein the second configuration is a liquid recovery configuration for recovering liquid refrigerant from a refrigerant circuit.

5. The refrigerant recovery system of claim 1, wherein the transfer circuit includes a bypass valve configured to selectively connect the first connection port and the second connection port.

6. The refrigerant recovery system of claim 1, wherein the transfer circuit includes a condenser, and in the second configuration, the discharge outlet of the vacuum pump is fluidly connected to the first connection port via the condenser, the second configuration being a gaseous refrigerant recovery configuration.

7. The refrigerant recovery system of claim 1, wherein in the first configuration, the vacuum pump is configured to suction gaseous refrigerant into the transfer circuit through the second connection port and to discharge liquid refrigerant from the transfer circuit through the first connection port, the gaseous refrigerant flowing from the vacuum pump to the first connection port being condensed, by a condenser, into the liquid refrigerant.

8. The refrigerant recovery system of claim 1, wherein in the third configuration, the vacuum pump is configured to discharge remaining refrigerant in the transfer circuit through the exhaust port.

9. The refrigerant recovery system of claim 1, wherein the plurality of multiple-way valves includes three or more of the multiple-way valves.

10. The refrigerant recovery system of claim 1, wherein the plurality of multiple-way valves includes two or more three-way valves.

11. A method of recovering refrigerant from a refrigerant circuit using a refrigerant recovery system, the refrigerant recovery system including a transfer circuit with a vacuum pump, a first connection port, a second connection port, an exhaust port, and a plurality of multiple-way valves, the method comprising:

operating the refrigerant recovery system in a liquid recovery configuration to transfer liquid refrigerant in the refrigerant circuit into one or more recovery cylinders, which includes:

adjusting the plurality of multiple-way valves such that a discharge outlet of the vacuum pump is fluidly connected to the refrigerant circuit via the second connection port, and a suction inlet of the vacuum pump is fluidly connected to the one or more recovery cylinders via the first connection port, and the vacuum pump suctioning from the one or more recovery cylinders and discharging into the refrigerant circuit; and operating the refrigerant recovery system in a gas recovery configuration to transfer gaseous refrigerant in the refrigerant circuit into the one or more recovery cylinders, which includes:

adjusting the plurality of multiple-way valves such that the discharge outlet of the vacuum pump is fluidly connected to the one or more recovery cylinders via the first connection port, and the suction inlet of the vacuum pump is fluidly connected to the refrigerant circuit via the second connection port, and the vacuum pump suctioning from the refrigerant circuit and discharging into the one or more recovery cylinders.

12. The method of claim 11, wherein the operating of the refrigerant recovery system in the liquid recovery configuration includes fluidly connecting the one or more recovery cylinders to the refrigerant circuit with a hose, and the vacuum pump suctioning from the one or more recovery cylinders and discharging into the refrigerant circuit causes the liquid refrigerant to flow through the hose from the refrigerant circuit to the one or more recovery cylinders.

13. The method of claim 11, wherein the transfer circuit includes a condenser, in the gas recovery configuration, the discharge outlet of the vacuum pump is fluidly connected to the first connection port via the condenser, and the transferring of the gaseous refrigerant in the refrigerant circuit from the refrigerant circuit into the one or more recovery cylinders includes condensing, with the condenser, the gaseous refrigerant into liquid refrigerant as the gaseous refrigerant flows through the transfer circuit.

14. The method of claim 11 wherein the refrigerant recovery system includes a heating tank, in the gas recovery configuration, the second connection port is fluidly connected to the refrigerant circuit via the heating tank, and the operating of the refrigerant recovery system in the gas recovery configuration includes evaporating, with the heating tank, liquid refrigerant mixed with the gaseous refrigerant suctioned from the refrigerant circuit.

15. The method of claim 11, further comprising:

operating the refrigerant recovery system in a gas charging configuration to transfer the gaseous refrigerant in the one or more recovery cylinders into the refrigerant circuit; and operating the refrigerant recovery system in a liquid charging configuration to transfer the liquid refrigerant in the one or more recovery cylinders into the refrigerant circuit.

16. The method of claim 11, wherein the refrigerant recovery system includes a refrigerant recovery cart with the transfer circuit.

17. The method of claim 11, wherein the transfer circuit includes a bypass valve configured to selectively connect the first connection port and the second connection port, the bypass valve being closed in the liquid recovery configuration and in the gas recovery configuration.

18. The method of claim 11, wherein the transfer circuit includes a bypass valve, and the method further comprises:

operating the refrigerant recovery system in a gas self-evacuation configuration, which includes:

adjusting the plurality of multiple-way valves and the bypass valve such that the suction inlet of the vacuum pump is fluidly connected to both the first connection port and the second connection port, and the discharge outlet of the vacuum pump is fluidly connected to the exhaust port, within the transfer circuit, discharging the gaseous refrigerant remaining in the transfer circuit into the one or more recovery cylinders via the exhaust port.

19. The method of claim 11, wherein the plurality of multiple-way valves includes three or more of the multiple-way valves.

20. The method of claim 11, wherein the plurality of multiple-way valves includes two or more three-way valves.

* * * * *